US007004464B2

(12) United States Patent
Hattori et al.

(10) Patent No.: US 7,004,464 B2
(45) Date of Patent: Feb. 28, 2006

(54) AUTOMATIC DOCUMENT FEEDER AND IMAGE PROCESSING APPARATUS LOADED WITH THE SAME

(75) Inventors: Hitoshi Hattori, Tokyo (JP); Hiroshi Fukano, Chiba (JP); Motoya Sano, Tokyo (JP); Takashi Fujii, Kanagawa (JP); Hiroshi Kubo, Saitama (JP); Shinya Kitaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 340 days.

(21) Appl. No.: 10/443,781

(22) Filed: May 23, 2003

(65) Prior Publication Data

US 2004/0004319 A1 Jan. 8, 2004

(30) Foreign Application Priority Data

May 23, 2002 (JP) ..... 2002-148831
May 2, 2003 (JP) ..... 2003-127081

(51) Int. Cl.
*B65H 7/02* (2006.01)

(52) U.S. Cl. ..... 271/258.03; 271/265.01

(58) Field of Classification Search ..... 271/258.01, 271/259, 258.03, 265.01, 265.02, 266, 10.01, 271/10.02, 10.03, 270, 242; 399/371, 372, 399/367, 370, 376

See application file for complete search history.

(56) References Cited

U.S. PATENT DOCUMENTS 4,331,328 A * 5/1982 Fasig ..... 271/270
4,451,027 A * 5/1984 Alper ..... 271/10.02
5,072,924 A * 12/1991 Sugiyama ..... 271/110
5,197,726 A * 3/1993 Nogami ..... 271/110
5,253,860 A 10/1993 Hirose et al.
5,330,170 A 7/1994 Uotani et al.
5,344,134 A 9/1994 Saeki et al.
5,383,754 A 1/1995 Sumida et al.
5,423,527 A * 6/1995 Tranquilla ..... 271/10.02
5,431,390 A 7/1995 Hirose et al.
5,461,468 A * 10/1995 Dempsey et al. ..... 399/396
5,484,143 A 1/1996 Hirose et al.
5,541,393 A * 7/1996 Ikezawa et al. ..... 235/98 R
5,541,713 A * 7/1996 Takatsuki et al. ..... 399/376
5,575,466 A * 11/1996 Tranquilla ..... 271/10.03
5,638,181 A 6/1997 Kubo et al.
5,639,171 A * 6/1997 Brewster et al. ..... 400/708
5,848,784 A * 12/1998 Tranquilla ..... 271/10.03
5,890,708 A * 4/1999 Song ..... 271/10.03
5,941,519 A 8/1999 Imoto et al.

(Continued)

FOREIGN PATENT DOCUMENTS

JP 59039646 A * 3/1984

(Continued)

*Primary Examiner*—Donald P. Walsh
*Assistant Examiner*—Matthew J. Kohner
(74) *Attorney, Agent, or Firm*—Oblon, Spivak, McClelland, Maier & Neustadt, P.C.

(57) ABSTRACT

An ADF (Automatic Document Feeder) for an image processing apparatus of the present invention includes a separating and feeding device for feeding one document from a stack of documents while separating the document from the others. A conveying device temporarily stops the document fed by the separating and feeding device at a position preceding a reading position and again conveys, on the elapse of a preselected period of time, the document toward the reading position. A controller controllably drives the separating and feeding device and conveying device. The controller drives the conveying device by controlling the time interval between the restart of conveyance of the preceding document and the restart of conveyance of the following document.

21 Claims, 17 Drawing Sheets

U.S. PATENT DOCUMENTS 5,946,527 A * 8/1999 Salgado et al. ..... 399/82
5,971,388 A 10/1999 Hattori et al.
6,023,034 A * 2/2000 Nakajima et al. ..... 209/584
6,076,821 A * 6/2000 Embry et al. ..... 271/10.01
6,089,561 A * 7/2000 Marshall et al. ..... 271/10.03
6,091,927 A 7/2000 Hattori et al.
6,118,972 A * 9/2000 Yamazaki et al. ..... 399/370
6,126,160 A * 10/2000 Ebert et al. ..... 271/10.03
6,257,692 B1 * 7/2001 Yokoi et al. ..... 347/16
6,285,853 B1 9/2001 Sano
6,322,069 B1 * 11/2001 Krucinski et al. ..... 271/265.02
6,354,583 B1 * 3/2002 Skadow et al. ..... 271/10.03
6,533,263 B1 * 3/2003 Tamura ..... 271/10.01
6,533,264 B1 * 3/2003 Tranquilla ..... 271/10.02
6,550,764 B1 * 4/2003 Wilson et al. ..... 271/270
6,554,275 B1 * 4/2003 Tranquilla ..... 271/259
6,612,572 B1 * 9/2003 Mohr et al. ..... 271/280
6,644,659 B1 * 11/2003 Skadow et al. ..... 271/265.02
6,644,660 B1 * 11/2003 Sussmeier et al. ..... 271/270
6,655,677 B1 * 12/2003 Marshall et al. ..... 271/10.03
6,685,184 B1 * 2/2004 Tufekci et al. ..... 271/270
6,702,274 B1 * 3/2004 Otsuka ..... 271/10.01
6,792,332 B1 * 9/2004 DePoi ..... 700/213
6,802,504 B1 * 10/2004 DePoi et al. ..... 271/259
6,836,640 B1 * 12/2004 Isemura et al. ..... 399/388
2003/0062671 A1 * 4/2003 Yasui et al. ..... 271/270
2004/0056410 A1 * 3/2004 Skadow et al. ..... 271/10.01

FOREIGN PATENT DOCUMENTS

JP 2001-160887 6/2001
JP 2001160887 A * 6/2001

* cited by examiner

AUTOMATIC DOCUMENT FEEDER AND IMAGE PROCESSING APPARATUS LOADED WITH THE SAME

BACKGROUND OF THE INVENTION

1. Field of the Invention

The present invention relates to a copier, facsimile apparatus, printer or similar image processing apparatus and an ADF (Automatic Document Feeder) mounted thereon. More particularly, the present invention relates to a sheet-through type of ADF configured to convey one of a stack of documents to a reading position while separating it from the other documents, and an image processing apparatus loaded with the same.

2. Description of the Background Art

A sheet-through type of ADF customary with a copier includes a document table on which desired documents are stacked. The ADF conveys the top sheet from the stack to a glass platen included in the copier and then drives it out of the copier to a stack tray. One of conventional ADFs of the type described is constructed to enhance read productivity, i.e., the number of documents read for unit minutes by omitting a stop for registration, which is used to match a conveying position and a reading position at a position just preceding the reading position.

More specifically, the ADF not executing a stop for registration includes, e.g., separating and feeding means for feeding one of a stack of documents while separating it from the others and conveying means for conveying the document to the reading position. When the preceding document is being read, the following document is fed and caused to wait for a moment until the distance between the preceding document and the following document increases to a preselected value. When the distance reaches the preselected value, the following document is again conveyed to a preselected position upstream of the reading position at high speed, thereby reducing the distance between the consecutive documents.

Further, the above ADF includes a document sensor responsive to the trailing edge of the preceding document arrived at preselected position to thereby indicate that the distance between the preceding and following documents has reached the preselected value. The following document is again conveyed in response to the resulting output of the document sensor. With such a configuration, the ADF is capable of enhancing read productivity without executing the stop-for-registration operation, thereby implementing high-speed conveyance.

The conventional ADF, however, has the following problem left unsolved. Because the following document begins to be conveyed when the trailing edge of the preceding document reaches a preselected position, read productivity varies in accordance with, e.g., the slip ratio of conveyance. In fact, it is extremely difficult to maintain conveying speed constant because the coefficient of friction of conveying means decreases and because the coefficient of friction is dependent on the kind of a document. If read productivity is not constant, then document reading and image writing to be effected at the same time in, e.g., a copier are brought out of synchronism with each other.

More specifically, when the conveying means is again driven at the moment when the trailing edge of the preceding document is sensed, the distance between the two consecutive documents increases if slip is noticeable, although the distance may remain constant so long as substantially no slip occurs. An increase in the above distance results in the fall of productivity. Further, the slip degrades conveyance when the number of documents to be read increases.

Technologies relating to the present invention are disclosed in, e.g., Japanese Patent Laid-Open Publication No. 2001-160887.

SUMMARY OF THE INVENTION

It is an object of the present invention to provide an ADF capable of preventing read productivity from varying in accordance with, e.g., the slip ratio by driving conveying means while controlling a time interval between consecutive documents, and an image processing apparatus provided with the same.

An ADF for an image processing apparatus of the present invention includes a separating and feeding device for feeding one document from a stack of documents while separating the document from the others. A conveying device temporarily stops the document fed by the separating and feeding device at a position preceding a reading position and again conveys, on the elapse of a preselected period of time, the document toward the reading position. A controller controllably drives the separating and feeding device and conveying device. The controller drives the conveying device by controlling the time interval between the restart of conveyance of the preceding document and the restart of conveyance of the following document.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
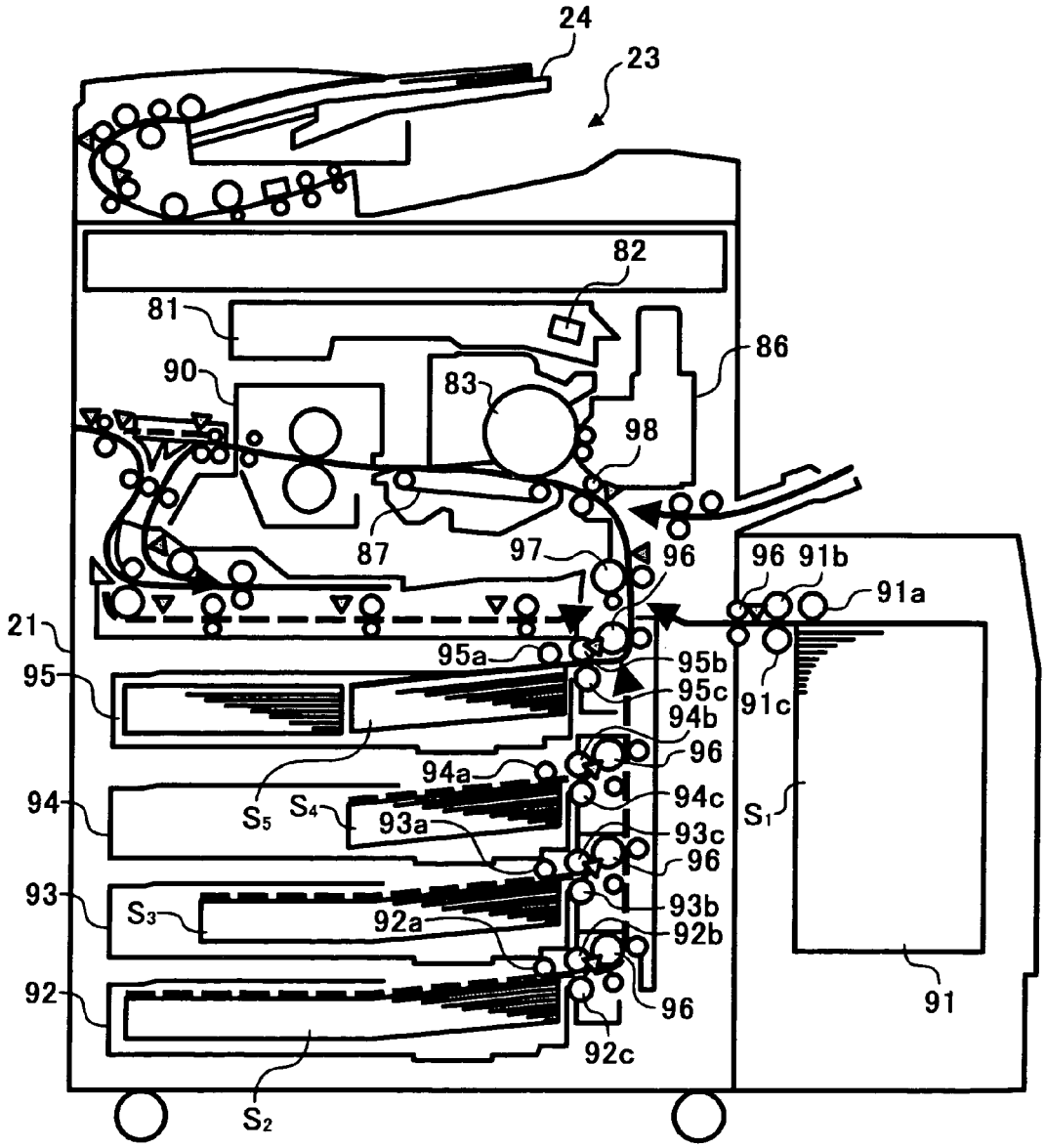
FIG. 1 is a view showing an image processing apparatus loaded with an ADF embodying the present invention.
Figure 2:
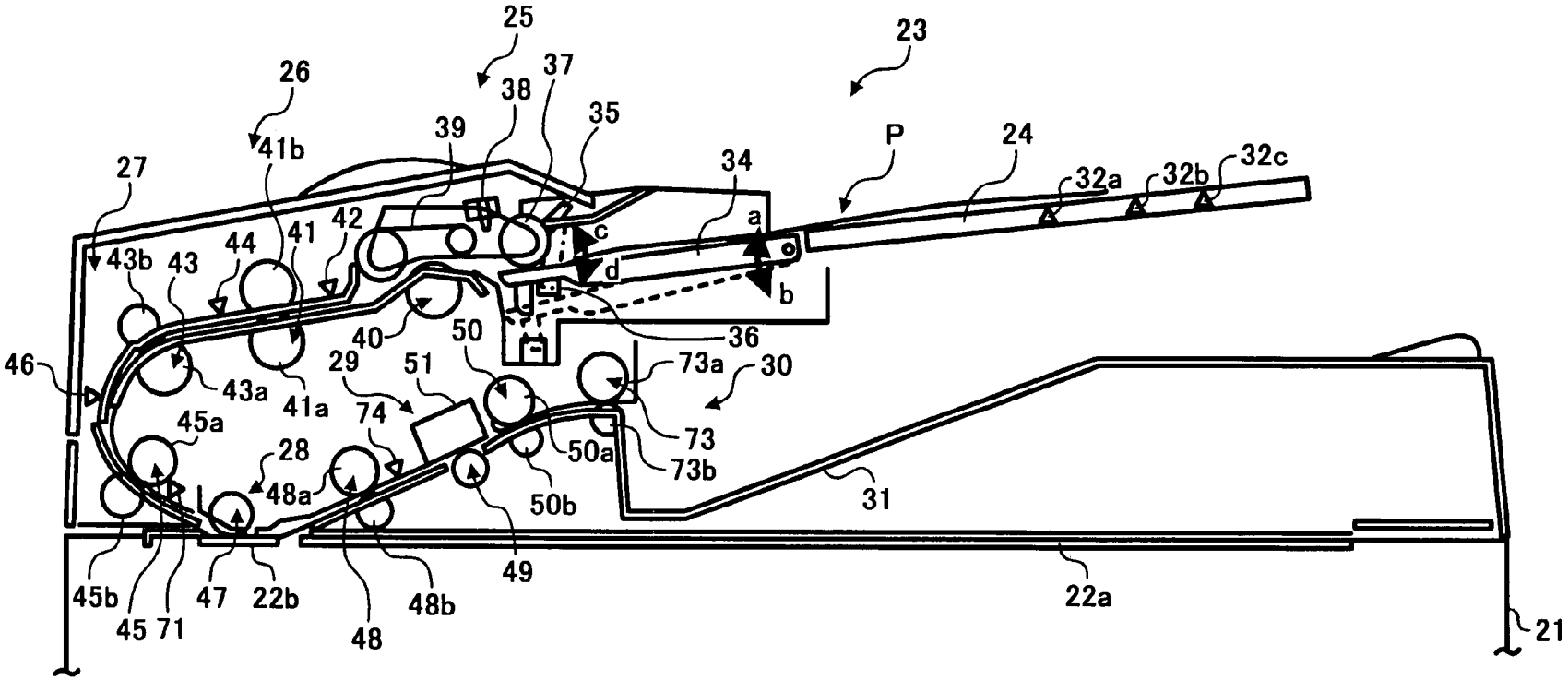
FIG. 2 is a view showing the configuration of the ADF specifically.

Referring to FIGS. 1 and 2 of the drawings, an image processing apparatus loaded with an ADF embodying the present invention is shown and implemented as a copier by way of example. As shown, the copier includes a copier body 21. A glass platen 22*a* and a slit glass (reading position) 22*b* smaller in area than the glass platen 22*a* are mounted on the upper surface of the copier body 21. An ADF 23 is mounted on the top of the casing 21 and hinged to the casing 21 in such a manner as to selectively cover or uncover the glass platen 22*a*.

The ADF 23 will be described more specifically with reference to FIGS. 2 through 7. As shown, the ADF 23 includes a document table 24 on which desired documents may be stacked face up. A sheet separating and feeding section or means 25 pays out one document from the stack while separating it from the other documents. A registering section 26 causes the document so paid out to abut thereagainst to thereby correct skew and conveys the sheet free from skew. A turning section 27 turns the document being conveyed and conveys it toward the slit glass 22*b*. A first reading and conveying section 28 includes a reading section, not shown, positioned beneath the glass platen 22 and configured to read one side or front surface of the document. A second reading and conveying section 29 reads the other side or reverse surface of the document read by the first reading and conveying section 28. The document whose opposite sides have been read is driven out of the ADF 23 via a discharging section 30 and stacked on a stacking section 31.

The ADF 23 further includes a pickup motor 101, a feed motor 102, a read motor 103, a discharge motor 104 and a bottom plate motor 105 for driving the above various sections and an ADF controller 100 for controlling the operation of the ADF 23.

Document length sensors 32*a*, 32*b* and 32*c* are positioned on the surface of the document table 24 and implemented by reflection type sensors or actuator type sensors capable of sensing even a single document. The output of any one of the document length sensors 32*a* through 32*c* representative of the length of a document or documents is sent to the ADF controller 100 The document length sensors 32*a* through 32*c* are therefore positioned on the document table 24 such that they are capable of determining at least whether the same document size is positioned in a profile position or whether it is positioned in a landscape position.

Figure 4:
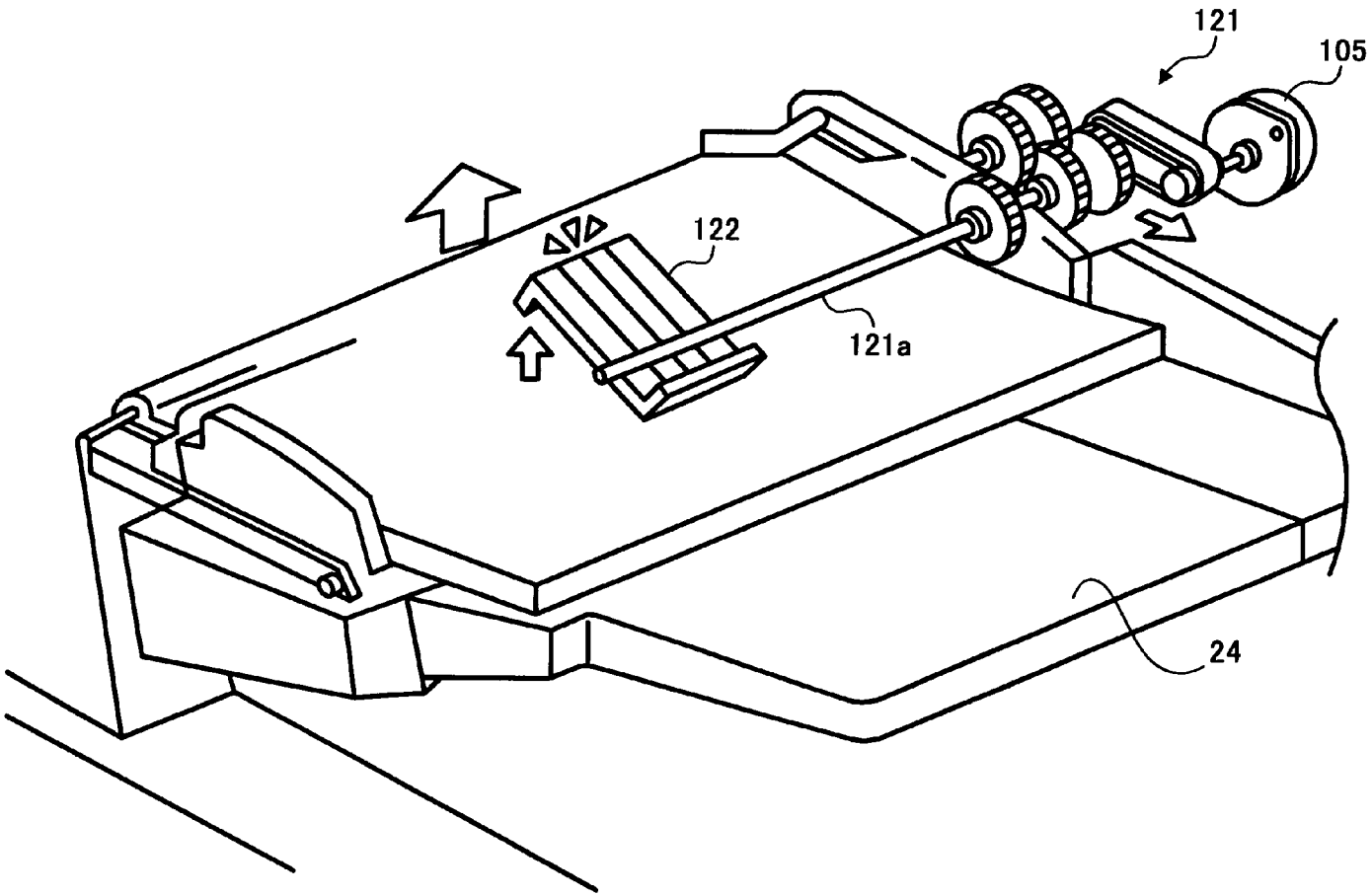
FIG. 4 is a fragmentary perspective view showing a mechanism for driving a movable table included in the ADF.

A movable table 34 is provided at the leading edge, i.e., downstream edge, as viewed in the direction of sheet conveyance, of the document table 24 and movable upward or downward in a direction a-b, FIG. 2, by being driven by the bottom plate motor 105. More specifically, as shown in FIG. 4, the bottom plate motor 105 is drivably connected to an elevation motor 122 via a driveline 121, which includes a timing belt, a gear train and a shaft member 121*a*. When the shaft member 121*a* is rotated by the bottom plate motor 105 via the driveline 121, a lever 122 affixed to the shaft member 121*a* selectively presses or releases the movable table 34, thereby moving the table 34 in the direction a-b.

Side guides, not shown, are positioned on the document table 24 for positioning a document stack in the direction of width, which is perpendicular to the direction of sheet conveyance.

A set feeler 35 and a document set sensor 36 are located in the vicinity of the movable table 34. When a document stack is put on the document table 24, the set feeler 35 is moved from a position indicated by a phantom line to a position indicated by a solid line. When the output of the document sensor 36 changes from one indicative of the presence of the set feeder 35 to one indicative of the absence of the same, the ADF controller 100 sends a signal to a body controller 111 included in the copier body 21 via an I/F (interface) or communicating means 107. In response, the body controller 111 prepares the copier body 21 for the reading of a document.

Figure 5:
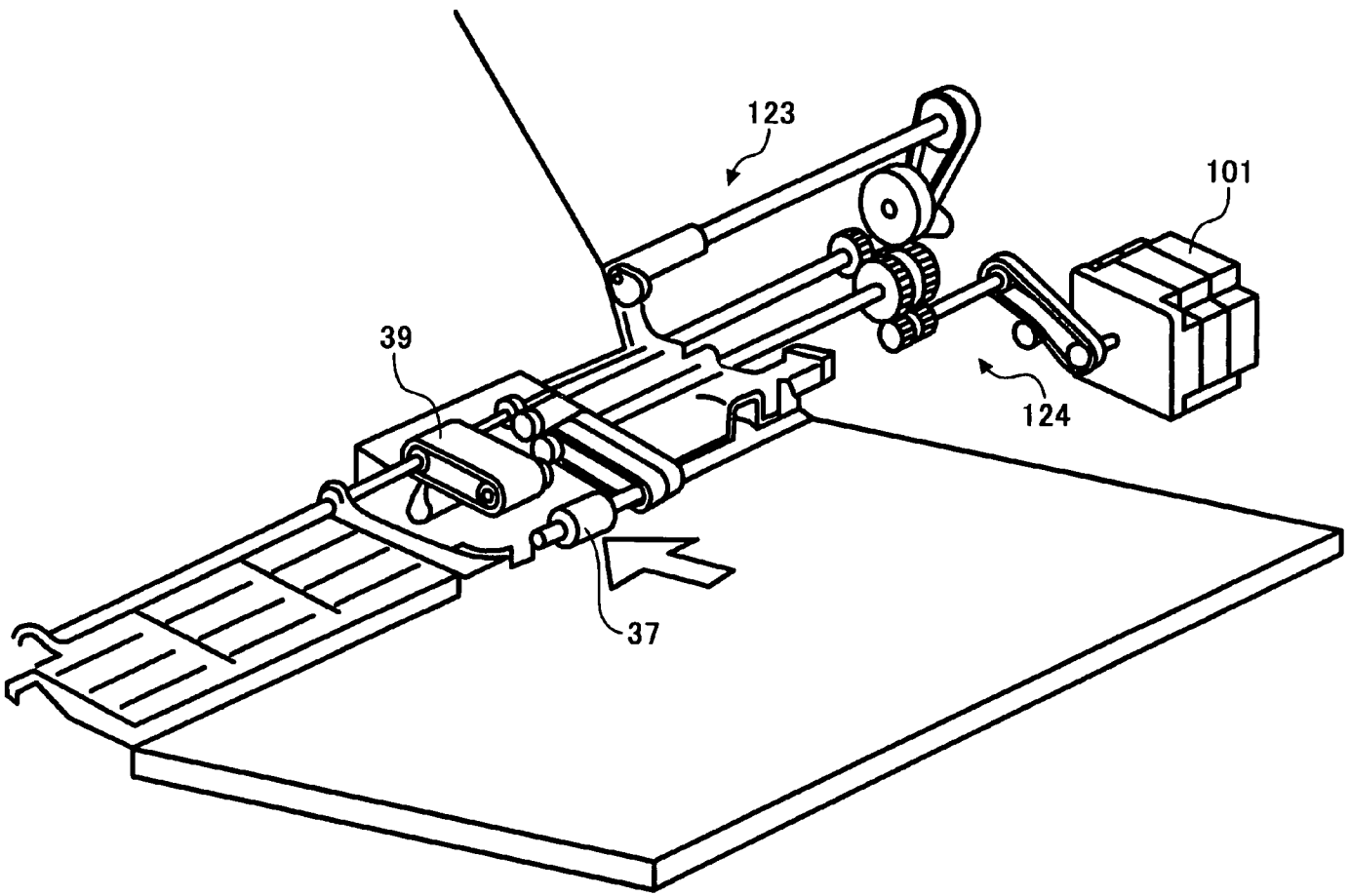
FIG. 5 is a fragmentary perspective view showing a mechanism for driving separating and feeding means included in the ADF.

When the ADF controller 100 determines, based on the output of the document set sensor 36, that a document stack is put on the document table 24, the ADF controller 100 drives the bottom plate motor 105 for thereby causing the top of the document stack to contact a pickup roller 37. As shown in FIG. 5, the output torque of the pickup motor 101 is transferred to the pickup roller 37 via a cam mechanism 123. In response, the pickup roller 37 moves between a position where it contacts the top of the sheet stack and a position where it is retracted from the same in a direction c-d, FIG. 2.

A table sensor 38 is positioned above the movable table 34. When the movable table 34 is elevated in the direction c and when the pickup roller 37 is elevated, the table sensor 38 senses the pickup roller 37 brought to its upper limit.

When the operator of the copier presses a print key, not shown, positioned on a control panel 108 mounted on the copier body 21, the body controller 111 sends a document feed signal to the ADF controller 100 via the I/F 107. In response, the ADF controller 100 drives the feed motor 102. The output torque of the feed motor 102 is transferred to the pickup roller 37 via a gear mechanism 124, causing the pickup roller 37 to rotate and start paying out several documents (ideally, a single document) from the document table 24.

A belt and a reverse roller 40 are positioned downstream of the pickup roller 37 and constitute separating and feeding means. When the feed motor 102 is rotated forward, the belt 39 turns clockwise, i.e., in the direction of document feed, At the same time, a torque limiter, included in the reverse roller 40, causes the reverse roller 40 to rotate clockwise, i.e., in the direction opposite to the direction of document conveyance. As a result, only the top document is paid out while being separated from the underlying documents.

More specifically, the reverse roller 40 is held in contact with the belt 39 under preselected pressure. When the reverse roller 40 contacts the belt 39 either directly or with the intermediary of a single document, the former rotates counterclockwise by following the rotation of the belt 39. When two or more documents enter the nip between the belt 39 and the reverse roller 40, the force causing the reverse roller 40 to follow the movement of the belt 39 decreases below the torque of the torque limiter. Consequently, the reverse roller 40 rotates clockwise, i.e., in the original direction of drive, returning the document or documents underlying the top document to thereby prevent two or more documents from being fed together. The belt 39 conveys the document separated from the others by the belt 39 and reverse roller 40.

An abut roller or rotatable abut member 41 is positioned downstream of the belt 39 and made up of a drive roller 41*a* and a driven roller 41*b*. The drive roller 41*a* is driven by the feed motor 102. The abut roller 41 corrects the skew of the document separated from the belt 39 and reverse roller 40 and then conveys the document to the downstream side. More specifically, in the event of document feed, the feed motor 102 remains turned off, maintaining the abut roller 41 in a halt. After an abutment sensor 42 positioned upstream of the abut roller 41 has sensed the document, the leading edge of the document abuts against the abut roller 41. When the abutment sensor 42 sends an output representative of the abutment of the document to the ADF controller 100, the ADF controller 100 drives the feed motor 102 by an amount corresponding to a preselected distance, causing the belt 39 to turn. Consequently, the document is pressed against the abut roller 41 while bending by a preselected amount.

Before the feed motor 102 is turned off, the pickup motor 101 is driven to retract the pickup roller 37 away from the top of the document stack. At this instant, the document is conveyed only by the belt 39 until the leading edge of the document enters the nip between the drive roller 41*a* and the driven roller 41*b* and has its skew corrected thereby. After the correction of the skew, the feed motor 102 is rotated in the reverse direction. At this instant, the abut roller 41 is driven by the feed motor 102 and conveys the document toward an intermediate roller 43. The intermediate roller 43 is made up of a drive roller 43*a* and a driven roller 43*b* and driven by the feed motor 102. It is to be noted that on the reverse rotation of the feed motor 102, the resulting drive is transferred to the abut roller 41 and intermediate roller 43, but is not transferred to the pickup roller 37 or the belt 39.

Figure 3:
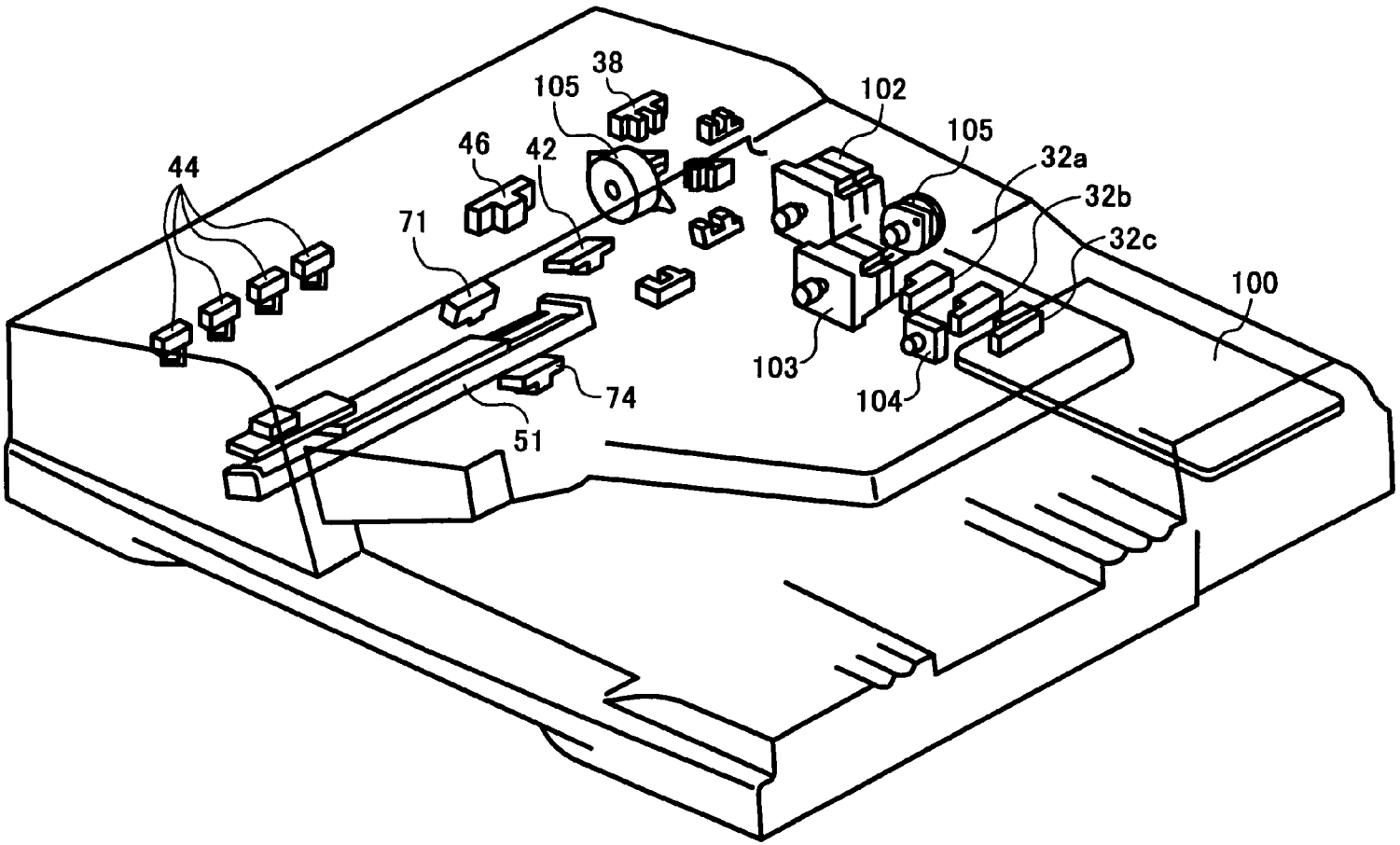
FIG. 3 is a perspective view showing the arrangement of sensors and motors included in the ADF.

As shown in FIG. 3, a plurality of (four in the illustrative embodiment) width sensors 44 are positioned downstream of the abut roller 41 and constitute document size sensing means. The outputs of the width sensors 44 representative of a document size are sent to the ADF controller 100. The controller 44 determines a document size in the direction of width, which is perpendicular to the direction of document conveyance, on the basis of an ON output of any one of the width sensors 44.

Further, the ADF controller 100 determines a document length in the direction of document conveyance on the basis of the output of the abutment sensor 42. For this purpose, the controller counts the pulses of the feed motor 102 from the time when the abutment sensor 42 turns on on sensing the leading edge of the document to the time when it turns off on sensing the trailing edge of the same document. In the illustrative embodiment, the abutment sensor 42 and ADF controller 100 constitute document size sensing means.

An inlet roller 45 is positioned downstream of the intermediate roller 43 and made up of a drive roller 45*a* and a driven roller 45*b*. The read motor 103 drives the intermediate roller 43.

A first read roller 47 is positioned on the slit glass 22*b* while a first outlet roller 48 is positioned downstream of the first read roller 47. The first read roller 47 is implemented as a drive roller while the first outlet roller 48 is made up of a drive roller 48*a* and a driven roller 48*b*.

A white roller 49 is positioned downstream of the first outlet roller 48 and implemented as a drive roller. A read outlet roller 50 is positioned downstream of the white roller 49 and made up of a drive roller 50*a* and a driven roller 50*b*. The read motor 103 drives the rollers 45, 47, 48, 49 and 50 as well.

An image sensor 51 is positioned above the white roller 49 for reading the other side of the document.

An inlet sensor 46 is located downstream of the intermediate roller 43 and sends its output to the ADF controller 100 on sensing the leading edge of the document. In response, the ADF controller 100 starts decelerating the feed motor 102 such that the document conveying speed coincides with the read conveying speed before the leading edge of the document enters the nip between the drive roller 45*a* and the driven roller 45*b* of the inlet roller 45. At the same time, the ADF controller 100 drives the read motor 103 forward to thereby connect the intermediate roller 43 to a driveline associated with the read motor 103 while driving the inlet roller 45, first read roller 47, first outlet roller 48, and white roller 49.

When the abut roller 41 and intermediate roller 43 are driven to convey the document from the registering section 26 to the turning section 27, the ADF controller 100 makes the conveying speed in the registering section 26 higher than the conveying speed in the conveying section 28. This successfully reduces processing time for delivering the document to the slit glass 22*b* and reduces the interval between consecutive documents.

A registration sensor 71 is located downstream of the inlet roller 45 and sends its output to the ADF controller 100 on sensing the leading edge of the document. In response, the ADF controller 100 decelerates the feed motor 102 over a preselected distance to thereby temporarily stop the document at a position preceding the slit glass 22*b*. At the same time, the ADF controller 100 sends a registration stop signal to the body controller 111 via the I/F 107. On receiving a read start signal from the body controller 111, the ADF controller 100 accelerates the read motor 103 such that the conveying speed increases to a preselected value before the leading edge of the document reaches the slit glass 22*b*, causing the intermediate roller 43 and inlet roller 45 to convey the document.

When the read start signal is input to the ADF controller 100 before the leading edge of the document arrives at the registration sensor 71, the ADF controller 100 executes reading without a stop for registration, i.e., while maintaining the read conveying speed (non-stop reading operation hereinafter).

At the time when the leading edge of the document reaches the slit glass 22*b*, as counted in terms of the number of pulses, the ADF controller 100 sends a gate signal representative of the effective area of the one side or first side of the document in the subscanning direction and continues to send it until the trailing edge of the document moves away from the slit glass 22*b*.

When the document carries an image only on one side thereof, the document moved away from the slit glass 22*b* is routed through the second reading and conveying section 29 to the discharging section 30. At this instant, when a discharge sensor 74 senses the leading edge of the document, the ADS controller 100 drives the discharge motor 100 forward for thereby rotating the discharge roller 73 counterclockwise. Subsequently, the ADF controller 100 decelerates the discharge motor 104 after the discharge sensor 74 has sensed the leading edge of the document, but just before the trailing edge of the same moves away from the nip between a drive roller 73*a* and a driven roller 73*b*, which constitute the discharge roller 73. This prevents the document driven out to the stacking section 31 from jumping out of the stacking section 31, Assume that the document carries images on both sides thereof. Then, the ADF controller 100 sends a gate signal representative of the effective image region of the document in the subscanning direction to the image sensor 51 from the time when, after the discharge sensor 74 has sensed the leading edge of the document, the leading edge reaches the image sensor 51, as determined in terms of the number of pulses of the read motor 103, to the time when the trailing edge of the document moves away from the image sensor 51

It is to be noted that the white roller 49 serves as reference white for obtaining shading data and prevents the document from rising when being read by the image sensor 51.

Figure 6:
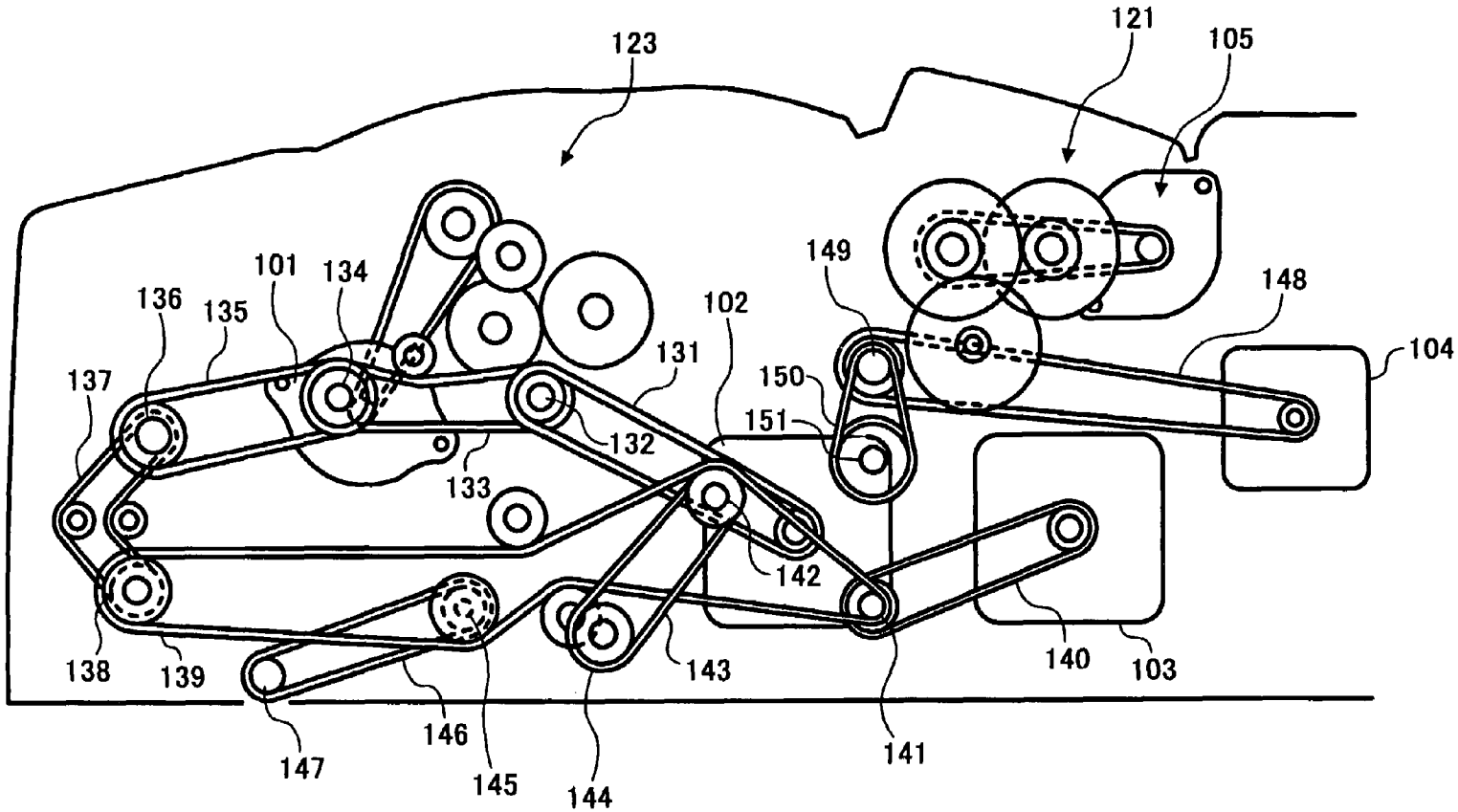
FIG. 6 is a view showing a mechanism for driving various rollers included in the ADF.
Figure 7:
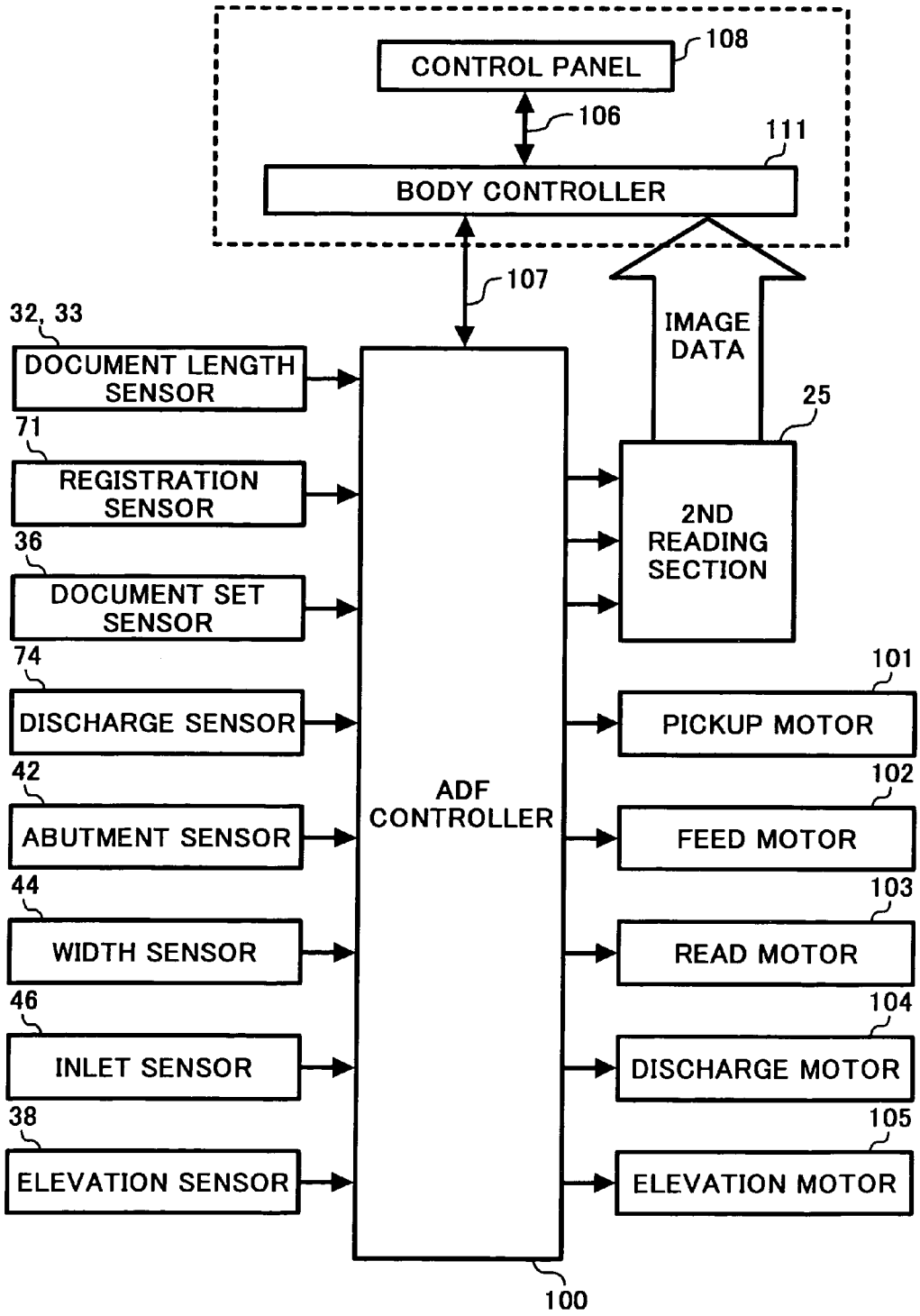
FIG. 7 is a block diagram schematically showing a control system included in the ADF.

The drivelines assigned to the abut roller 41 and intermediate roller 43 as well as the other rollers will be described with reference to FIG. 6. As shown, the feed motor 102 is connected to a pulley 132 via a timing belt 131. The pulley 132 is, in turn, connected to the drive roller 39*a* of the belt 39 via a gear mechanism including a one-way clutch and connected to the reverse roller 40 via a gear mechanism. Further, the pulley 132 is connected by a timing belt 133 to a pulley 134 that drives the drive roller 41*a* of the abut roller 41. The pulley 134 is connected by a timing belt 135 to a pulley 136 that drives the drive roller 43*a* of the intermediate roller and includes a one-way clutch.

The pulley 136 is connected by a timing belt 137 to a pulley 138 that drives the drive roller 45*a* of the inlet roller 45. The pulley 138 is, in turn, connected to a timing belt 139 driven by the read motor 103.

On the other hand, the read motor 103 is connected by a timing belt 140 to a pulley 141 that is, in turn, connected to the timing belt 139. Further, the timing belt 139 is connected to a pulley 142 that drives the read outlet roller 50.

The pulley 142 is connected by a timing belt 143 to a pulley 144 that is, in turn, connected to the white roller 49 via a gear mechanism. A pulley 145 is connected to the timing belt 139 and drives the first outlet roller 48. Further, the pulley 145 is connected by a timing belt 146 to a pulley 147 that drives the first read roller 47.

As stated above, the feed motor 102 drives the belt 39, reverse roller 40, abut roller 41 and intermediate roller 43 via the timing belts. The read motor 103 drives the inlet roller 45, first read roller 47, first outlet. roller 48, white roller 49 and read outlet roller 50 via the timing belts. While the intermediate roller 43 is connected to the inlet roller 45 by the timing belt 137 and connected to the read motor 103 by the timing belt 139, the pulley 136 with the one-way clutch rotates along with the intermediate roller 43 or rotates, when the reverse roller 40 rotates, by following the rotation of the reverse roller 40 via the timing belt 135.

The discharge motor 104 is connected by a timing belt 148 to a pulley 149 that is, in turn connected by a timing belt 150 to a pulley 151 configured to drive the discharge roller 73.

As shown in FIG. 1, a reading section 81 is disposed in the copier body 21 and includes a light source, mirrors, a lens, and a CCD (Charge Coupled Device) image sensor or similar image sensor, although not shown specifically. A writing section 82 optically scans a photoconductive drum or image carrier 83 in accordance with image data output from the reading section 81.

Figure 8:
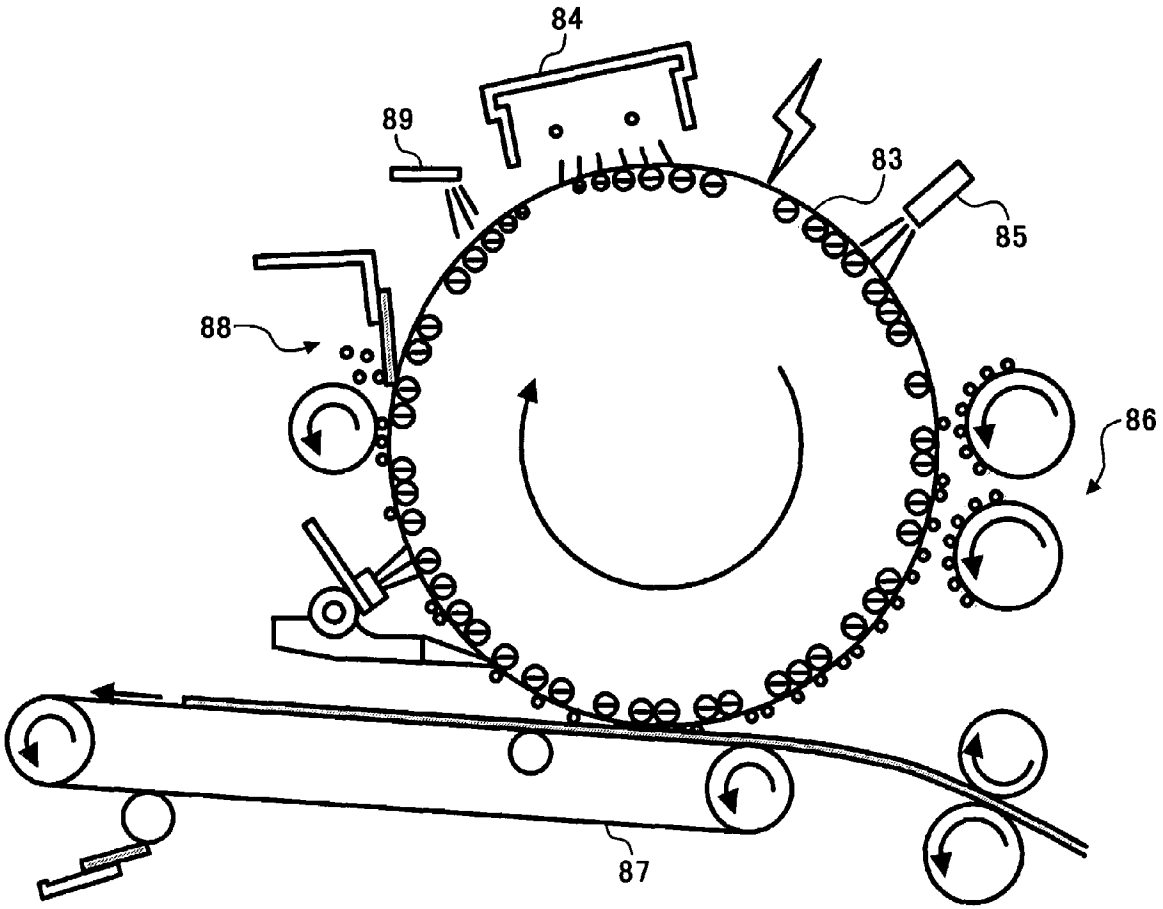
FIG. 8 is a view showing a specific configuration of an image forming section included in the image processing apparatus.

As shown in FIG. 8, a charger 84, a potential sensor 85, a developing unit 86, an image transfer belt 87, a cleaning unit 88 and a quenching lamp or discharger 89 are arranged around the drum 83. The charger 84 uniformly charges the surface of the drum 83 in the dark by positive corona discharge. The writing section 82 scans the charged surface of the drum 83 with a laser beam in accordance with image data to thereby remove negative charge. As a result, a latent image representative of a document image is formed on the drum 83. The potential sensor 85 measures potential on the drum 83, so that correction is effected by process control. The developing unit 86 deposits toner charged to negative polarity on the latent image of the drum 83, thereby producing a corresponding toner image.

The toner image of negative polarity is transferred from the drum 83 to the image transfer belt 87 charged to positive polarity. The cleaning unit 88 includes a cleaning blade configured to scrape off the toner left on the drum 83 after the image transfer. Subsequently, the quenching lamp 89 removes charge left on the drum 83 for thereby preparing it for the next image forming cycle. Thereafter, the toner image is transferred from the image transfer belt 87 to a sheet or recording medium. The sheet with the toner image is conveyed to a fixing unit 90 and has the toner image fixed thereby.

As shown in FIG. 1, sheet cassettes 91 through 95 are disposed in the copier body 21 one above the other and respectively loaded with sheets S1 through S5 different in size from each other. Pickup rollers 91*a* through 95*a*, feed rollers 91*b* through 95*b* and reverse rollers 91*c* through 95*c* are assigned to the sheet cassettes 91 through 95, respectively. A sheet paid out from any one of the sheet cassettes 91 through 95 by the associated pickup roller, separates from the underlying sheets by the feed roller and reverse roller, which contacts the feed roller, and then conveyed to a registration roller pair 98 by roller pairs 96 and 97 The registration roller pair 98 conveys the sheet to the nip between the drum 83 and the image transfer belt 87 at preselected timing.

In the illustrative embodiment, when the read start signal mentioned earlier is sent from the body controller 111 to the ADF controller 100 before the leading edge of the document arrives at the registration sensor 71, the ADF controller 100 executes the non-stop reading operation, as stated previously. In this case, the abut roller or conveying means 41 stops the leading edge of the document for a moment and again conveys it toward the slit glass 22*b* on the elapse of a preselected period of time. The ADF controller 100 includes a timer for counting a time interval between the start of re-conveyance of the preceding document and that of the following document as a preselected period of time mentioned above. On the elapse of the preselected period of time, the ADF controller 100 drives the feed motor 102 and therefore abut roller 41 In the illustrative embodiment, the ADF controller 100 and feed motor 102 constitute drive control means.

The illustrative embodiment uses the timer of the ADF controller 100 for counting the preselected period of time, as stated above. Alternatively, a timer may be included in the body controller 111 in order to count the preselected period of time as well as periods of time relating to the operation of the copier and that of the ADF 23. This reduces the number of timers required and therefore the cost of the entire copier.

Specific procedures unique to the illustrative embodiment will be described hereinafter.

First Procedure

Figure 9:
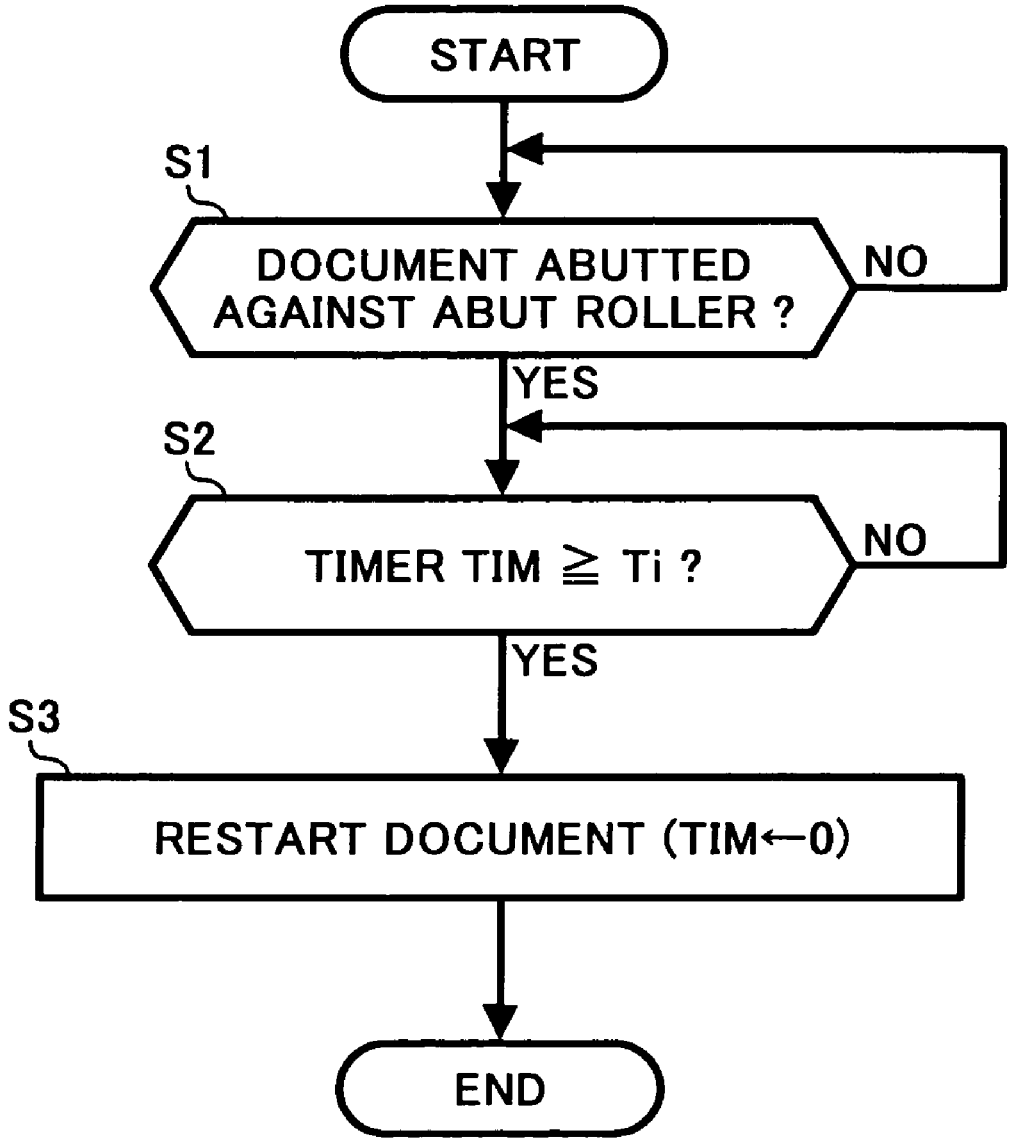
FIG. 9 is a flowchart demonstrating a first specific procedure unique to the illustrative embodiment.

Reference will be made to FIG. 9 for describing a first specific procedure. First, when a document stack P is put on the document table 24, the output from the document sensor 36 changes from one representative of the presence of the set feeder 35 to one representative of the absence of the same. In response, the ADF controller 100 drives the bottom plate motor 105 until the top of the document stack P rises to contact the pickup roller 37.

Subsequently, when the print key on the control panel 108 of the copier body 21 is pressed, the body controller 111 sends a document feed signal to the ADF controller 100 via the I/F 107. In response, the ADF controller 100 drives the feed motor 102 forward to thereby turn the belt 39 clockwise while rotating the reverse roller 40 clockwise, so that a document on the top of the stack P is paid out.

Assume that the abutment sensor 42 senses the leading edge of the document before the registration sensor 71 receives a read start signal. Then, the ADF controller 100 drives the feed motor 102 by a preselected distance to thereby turn the belt 39, so that the document is conveyed by the preselected distance. As a result, the leading edge of the document abuts against the abut roller 41 and is pressed thereagainst, so that the document bends by a preselected amount and has its skew corrected (step S1). The ADF controller 100 then determines whether or not a timer count TIM representative of a time interval between documents is equal to or greater than a preselected value (set time interval hereinafter) Ti (step S2). If the answer of the step S2 is positive (yes), then the ADF controller 100 resets the timer count TIM (step S3) to thereby end control over the time interval between documents. Subsequently, the ADF controller 100 again drives the abut roller 41 in order to convey the document toward the slit glass 22*b*. Such steps are repeated in the same manner with the following document.

Why the ADF controller 100 controls the time interval between consecutive documents will be described hereinafter. If a stop for registration is not effected, then read productivity, i.e., the number of documents read for unit minutes increases. However, assume that when the trailing edge of the preceding document arrives at a preselected position, the abut roller 41, for example, starts conveying the following document as in the conventional system. Then, read productivity varies in accordance with, e.g., the slip ratio of conveyance. Assuming the moment when the abut roller 41 stopped a document again starts conveying it at high speed, then the time interval between the restart of the preceding document and that of the following document is the set time interval Ti (second), so that productivity is expressed as 60 (for 1 minute)/Ti.

In the above condition, the distance between documents is maintained constant and therefore improves read productivity so long as documents slip little, but the distance between documents increases when the slip is noticeable, eventually lowering read productivity. As the number of documents increases, read productivity is lowered by such distances sequentially accumulated. Should read productivity be not constant, document reading and image writing would be brought out of synchronism.

In this specific procedure, the timer included in the ADF controller 100 manages the set time interval Ti, i.e., the time interval between the restart of the preceding document and that of the following document. For example, when a desired set time interval Ti is 1 second (productivity of 60 documents/minute), read productivity can be maintained constant if the following document is restarted on the elapse of 1 second since the restart of the preceding document and if this control is repeated with the successive documents as well.

Further, the abut roller 41 once stops the leading edge of a document and then again conveys it for thereby correcting the skew of the document. In addition, because the abut roller 41 accurately positions the leading edge of the document, the distance between the preceding document and the following document is maintained constant.

Moreover, because the time interval between documents should preferably be coincident with the interval between the time when the preceding document is restarted and the time when the trailing edge of the document is sensed by the registration sensor 71 preceding the glass platen 22*b*. This allows the following document to be restarted when the distance between the preceding and following documents coincides with a certain value, preventing the distance between documents from becoming excessively small.

Second Procedure

Figure 10:
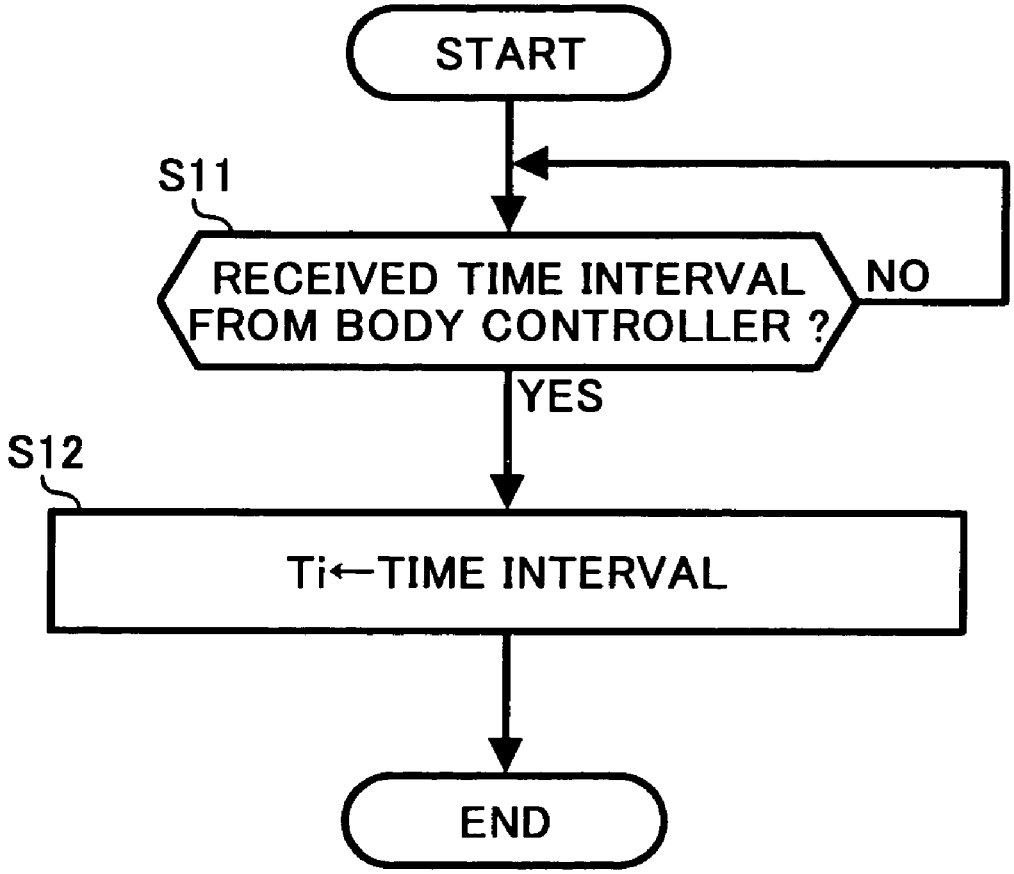
FIG. 10 is a flowchart demonstrating a second specific procedure unique to the illustrative embodiment.

While the first procedure controls the time interval between documents with the ADF controller 100, a second procedure sets the above interval and sends it to the ADF controller 100 via the I/F 107. More specifically, as shown in FIG. 10, the ADF controller 100 determines whether or not a time interval between documents is received from the body controller 111 (step S11). If the answer of the step S11 is yes, then the ADF controller 100 updates the set time interval Ti (step S12) and then controls the abut roller 41 in accordance with the set time interval Ti. The second procedure therefore allows an optimum time interval between documents to be set in accordance with various conditions including a document size and a copy mode.

Third Procedure

In a third specific procedure, the ADF controller 100 determines a document size on the basis of a width sensed by the document width sensor 44 and a length sensed by the abutment sensor 42 and ADF controller 100. The ADF controller 100 then sends the document size so determined to the body controller 111 via the I/F 107. In response, the body controller 111 sets a time interval between documents in accordance with the document size and then sends the interval to the ADF controller 100 via the I/F 107. The ADF controller 100 drives the abutment roller 41 in accordance with the time interval received.

Figure 11:
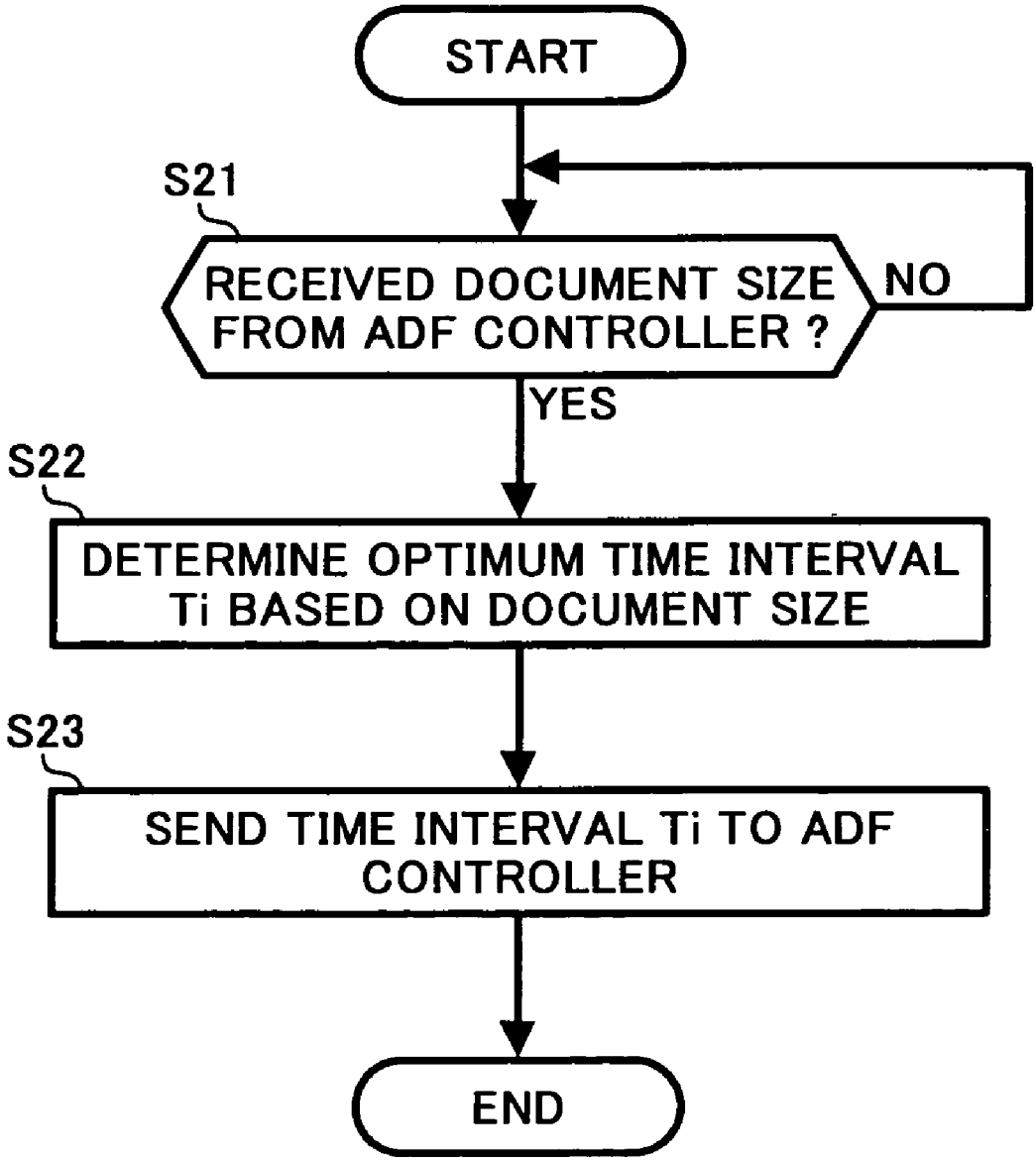
FIG. 11 is a flowchart demonstrating a third specific procedure unique to the illustrative embodiment.

More specifically, as shown in FIG. 11, the body controller 111 determines whether or not it has received a document size signal relating to the first document from the ADF controller 100 via the I/F 107 (step S21). If the answer of the step S21 is yes, then the body controller 111 selects an optimum set time interval Ti in accordance with the document size signal (step S22) and then sends the optimum set time interval Ti to the ADF controller 100 via the I/F 107 (step S23). In response, the ADF controller 100 drives the abut roller 41 via the feed motor 102 such that the time interval between the restart of the preceding document and that of the following document remains constant.

Setting a time interval between documents on the basis of a document size, as stated above, is significant for the following reason. A document of size A3 set in a profile position, for example, is two times as long as a document of size A4 set in a landscape position and needs two times as long a period of time as the latter to be fully read. Therefore, a longer set time interval Ti should be assigned to the A3 profile document than to the A4 landscape document. In this sense, by freely selecting the optimum set time interval Ti in matching relation to the document size, it is possible to control conveyance in accordance with the document size.

To control conveyance, a time interval between documents determined in accordance with the sheet size may be used in addition to the document size, in which case a set time interval Ti matching with the sheet size will be sent to the ADF controller 100 via the I/F 107. More specifically, assuming that the sheet size is A and that the set time interval is Ti, then the set time interval is doubled to 2Ti for a sheet size of 2A. With this scheme, it is possible to attain desirable images with a copier of the type effecting image reading and image formation in synchronism. Further, in the case of a copier of the type storing image data in a memory, e.g., a copier with a facsimile function or a facsimile apparatus, when much facsimile data received are written to the memory, load on the memory does not increase. In addition, the memory can be used as a buffer and therefore needs a minimum of capacity.

Forth Procedure

In a fourth specific procedure, the ADF controller 100 also determines a document size on the basis of a width sensed by the document width sensor 44 and a length sensed by the abutment sensor 42 and ADF controller 100. If the document size so determined is a preselected size, the ADF controller 100 sends a document size signal to the body controller 111 via the I/F 107. In response, the body controller 111 sends a set time interval selected in accordance with the document size to the ADF controller 100 via the I/F 107. The ADF controller 100 drives the abut roller 41 in accordance with the set time interval received.

Figure 12:
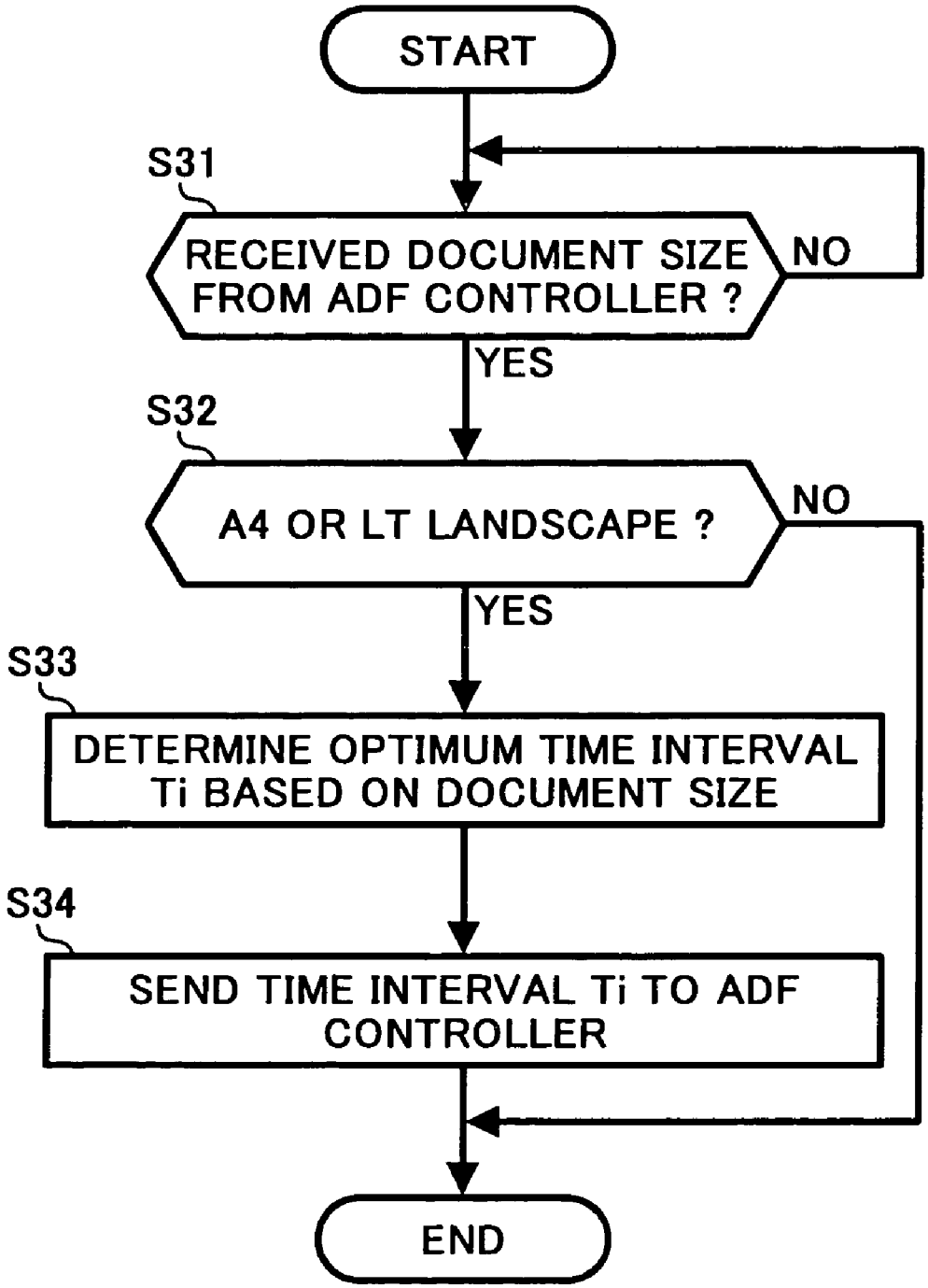
FIG. 12 is a flowchart demonstrating a fourth specific procedure unique to the illustrative embodiment.

More specifically, as shown in FIG. 12, the body controller 111 determines whether or not it has received a document size from the ADF controller 100 (step S31). If the answer of the step S31 is yes, then the body controller 111 determines whether or not the document size received is representative of an A4 landscape document or an LT landscape document (11×8.5 inches) whose read productivity is indicated in a catalogue (step S32) If the answer of the step S32 is yes, then the body controller 111 selects an optimum set time interval Ti (step S33) and sends it to the ADF controller 100 via the I/F 107 (step S34). The ADF controller 100 drives the abut roller 41 in accordance with the set time interval Ti received.

If the answer of the step S32 is negative (no), then the ADF controller 100 executes the stop-for-registration operation, i.e., interrupts the conveyance of the document when the registration sensor 71 senses the leading edge of the document. Subsequently, the body controller 111 sends a read start signal to the ADF controller 100 via the I/F 107. Consequently, even when the preparation for reading is delayed, compared to the usual preparation, the document can be stably read without any jam or error.

Fifth Procedure

In a fifth specific procedure, when the copier body 21 operates in a preselected image forming mode, the ADF controller 100 receives a set time interval from the body controller 111 via the I/F 107 and drives the abut roller 41 in accordance with the set time interval received.

Figure 13:
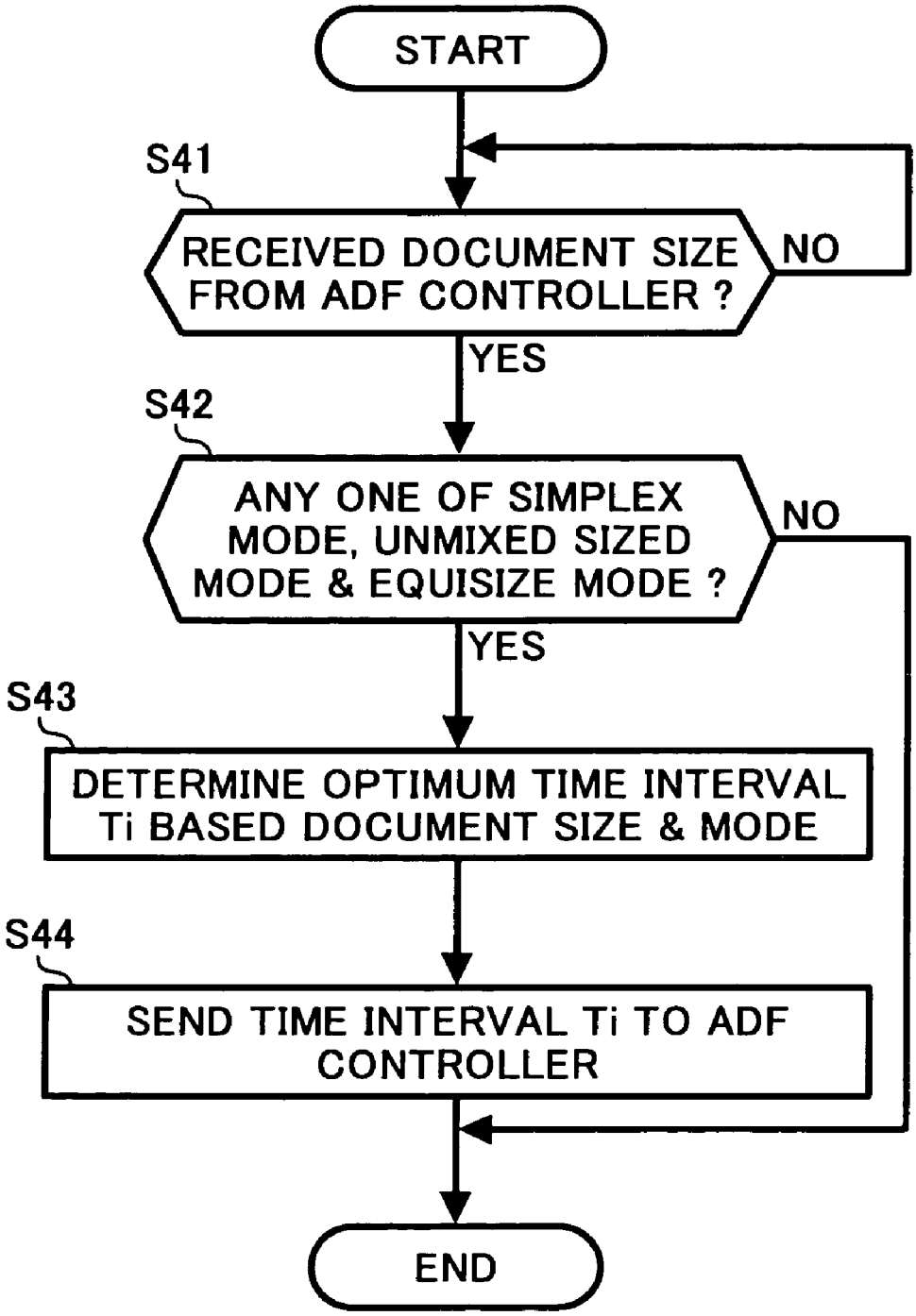
FIG. 13 is a flowchart demonstrating a fifth specific procedure unique to the illustrative embodiment.

More specifically, as shown in FIG. 13, when the body controller 111 receives a document size signal from the ADF controller 100 via the I/F 107 (yes, step S41), the body controller 111 determines whether or not the copying mode of the copier body 21 is a preselected mode that allows non-stop reading to be executed for enhancing read productivity, e.g., a mode indicated in a catalogue or a mode to be mainly used (step S42). More specifically, the body controller 111 determines whether the mode is any one of a simplex copy mode, a unmixed size mode, and an equisize read mode (step S43). If the answer of the step S43 is yes, then the body controller 111 selects an optimum set time interval Ti in accordance with the document size and copying mode (step S43). The body controller 111 then sends the set time interval Ti to the ADF controller 100 via the I/F 107 (step S44). In response, the ADF controller 100 drives the abut roller 41 in accordance with the set time interval Ti received.

If the answer of the step S42 is no, then the ADF controller 100 executes the stop-for-registration operation and then interrupts conveyance when the registration sensor 71 senses the leading edge of the document. Subsequently, the body controller 111 sends a read start signal to the ADF controller 100. This is also successful to read the document without any jam or error even when the preparation for reading is delayed.

Sixth Procedure

In a sixth specific procedure, when the copier body 21 operates in a preselected image forming mode and when the document size is a preselected size, the ADF controller 100 receives a set time interval from the body controller 111 via the I/F 107 and drives the abut roller 41 in accordance with the set time interval.

Figure 14:
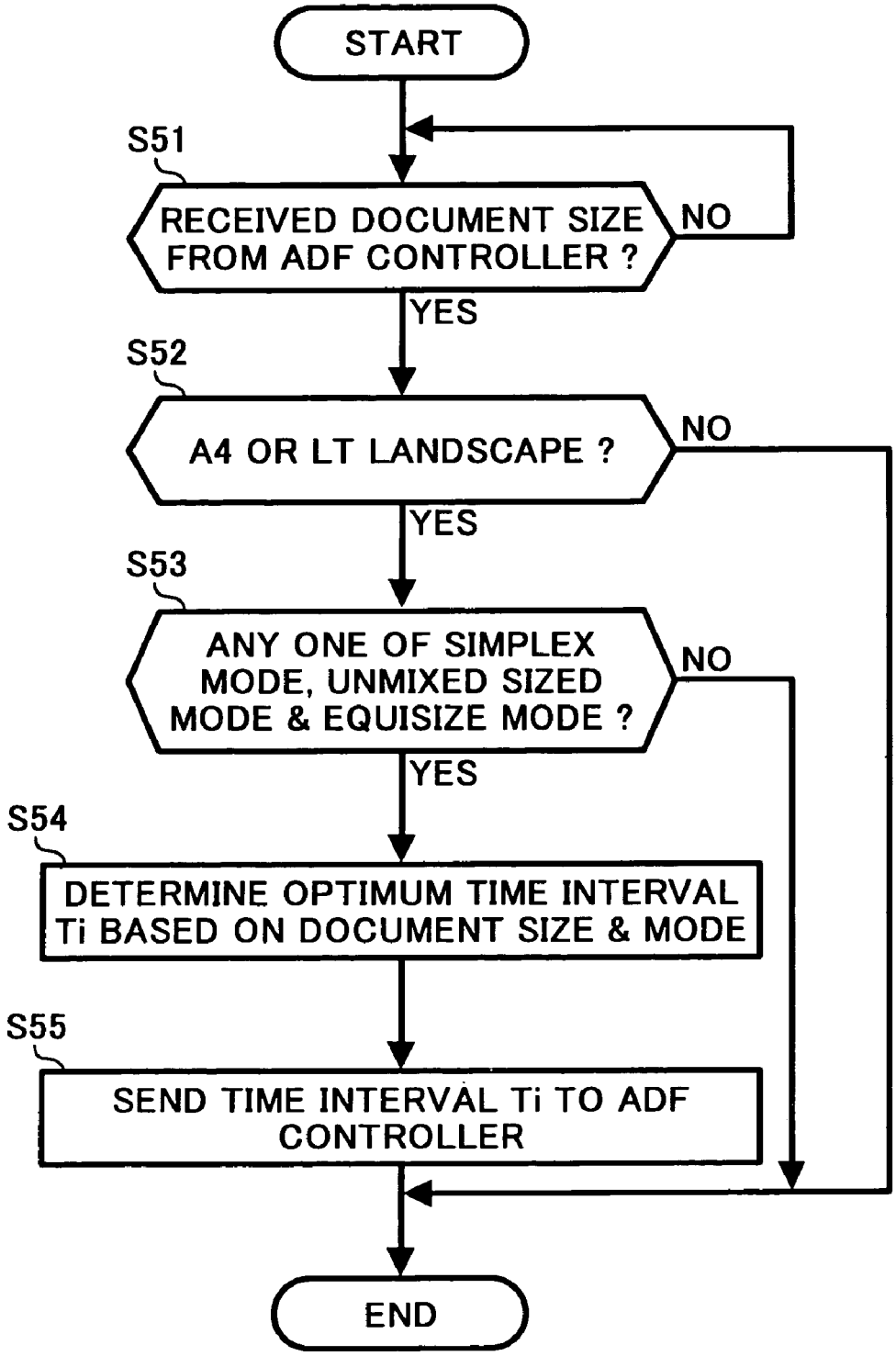
FIG. 14 is a flowchart demonstrating a sixth specific procedure unique to the illustrative embodiment.

More specifically, as shown in FIG. 14, the body controller 111 determines whether or not it has received a document size signal from the ADF controller 100 via the I/F 107 (step S51). If the answer of the step S51 is yes, then the body controller 111 determines whether or not the document size received is a preselected document size that allows read productivity to be enhanced and is indicated in a catalogue or mainly used, e.g., an A4 landscape document or an LT landscape document (11×8.5 inches) whose read productivity is indicated in a catalogue (step S52).

Subsequently, the body controller 111 determines whether or not the copying mode of the copier body 21 is a preselected mode that allows read productivity to be enhanced, as indicated in a catalogue by way of example. More specifically, the body controller 111 determines whether the mode is any one of a simplex copy mode, an unmixed size mode, and an equisize read mode (step S53). If the answer of the step S53 is yes, then the body controller 111 selects a set time interval Ti matching with the document size and copying mode (step S54) and sends the set time interval Ti to the ADF controller 100 (step S55). In response, the ADF controller 100 drives the abut roller 41 in accordance with the set time interval Ti.

If the answer of the step S52 or S53 is no, then the ADF controller 100 executes the stop-for-registration operation and then interrupts conveyance when the registration sensor 71 senses the leading edge of the document. Subsequently, the body controller 111 sends a read start signal to the ADF controller 100. This is also successful to read the document stably without any jam or error even when the preparation for reading is delayed.

Seventh Procedure

Figure 15:
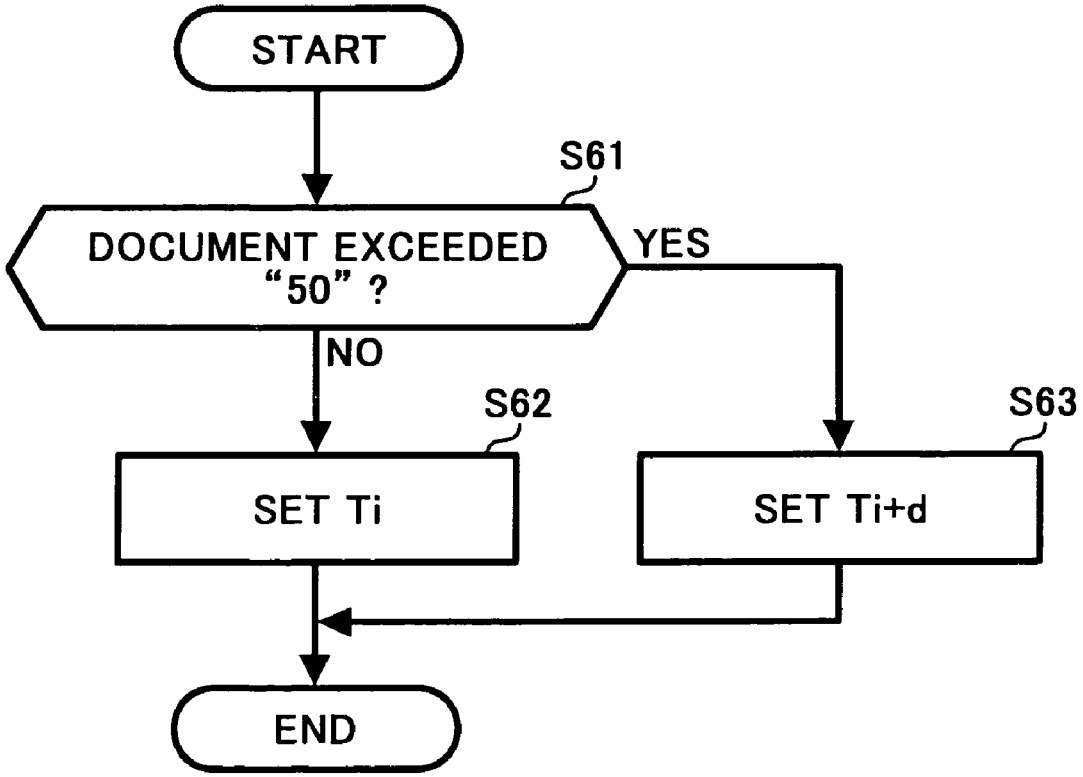
FIG. 15 is a flowchart demonstrating a seventh specific procedure unique to the illustrative embodiment.

In a seventh specific procedure, the set time interval Ti is varied between the start and the end of conveyance of a document stack, i.e., the set time interval Ti is extended when a preselected number of documents are conveyed, More specifically, as shown in FIG. 15, whether or not the number of documents conveyed is greater than fifty is determined on the basis of how many times the registration sensor 71 has sensed the leading edge of a document (step S60). If the answer of the step S60 is no, then any suitable set time interval Ti is selected (step S62) If the answer of the step S60 is yes, then the set time interval Ti is extended to Ti+α (α=about 0.2 second) (step S63).

Why the set time interval is varied between the start and the end of conveyance of a document stack is that consideration is given to the probability of slip tending to increase with an increase in the number of consecutive documents conveyed. More specifically, assume that the set time interval is Ti (second) for the first to fiftieth documents or Ti+α (second) for the fifty-first and successive documents, as stated above. Then, when the fifty-first and successive documents are liable to slip, top priority is given to the obviation of a jam by protecting conveyance from the influence of the set time interval.

Eighth Procedure

In an eighth specific procedure, the ADF controller 100 controls conveyance such that the time interval between documents increases every time a preselected number of documents are conveyed.

Figure 16:
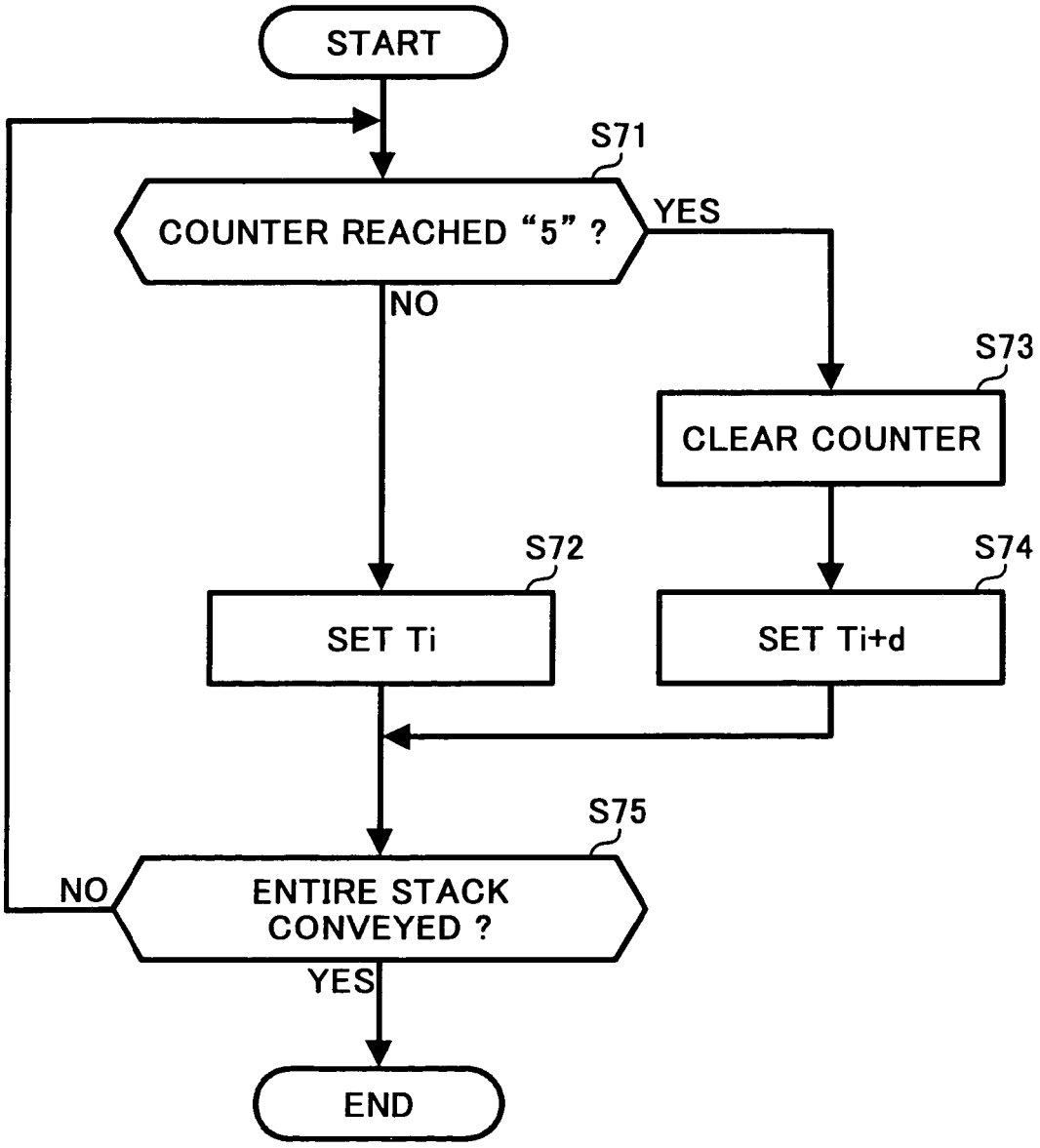
FIG. 16 is a flowchart demonstrating a eighth specific procedure unique to the illustrative embodiment.

More specifically, as shown in FIG. 16, whether or not the count of a document counter has reached, e.g., "5" is determined on the basis of the number of outputs of the registration sensor 71 (step S71). If the answer of the step S71 is no, then any suitable set time interval Ti is selected (step S72), and then the document is conveyed in accordance with the set time interval Ti. It is to be noted that the document counter mentioned above is included in the ADF controller 100.

If the answer of the step S71 is yes, then the document counter is cleared (step S73), and then the set time interval Ti is increased to Ti+α (α=about 1 second) (step S74). The document is therefore conveyed in accordance with the set time interval Ti+α.

After the step S72 or S74, whether or not the entire document stack has been conveyed is determined (step S75). If the answer of the step S75 is no, then the procedure returns to the step S71.

Assume that the copier body 21 is inferior in performance to the ADF 23, e.g., the document reading speed of the copier body 21 is lower than the document conveying speed of the ADF 23. Then, the specific procedure described above extends the time interval between documents one time for every five sheets, so that the reading speed of the copier can follow the conveying ability of the ADF 23.

The eighth procedure may interrupt control over the time interval between sheets one time for every five sheets instead of extending the conveying time at the same rate. In such a case, there will be executed the stop-for-registration operation that stops the leading edge of the document at the registering position in accordance with the output of the registration sensor 71.

Ninth Procedure

In a ninth specific procedure, the ADF controller 100 counts the pulses of the feed motor 102 from the time when the inlet sensor 46 senses the leading edge of a document to the time when the abutment sensor senses the trailing edge of the same document. If the resulting count is greater than normal one β indicative of slip-free conveyance (β+α), then the ADF controller 100 determines that slip has occurred, and varies the time interval between documents in accordance with the slip ratio.

Figure 17:
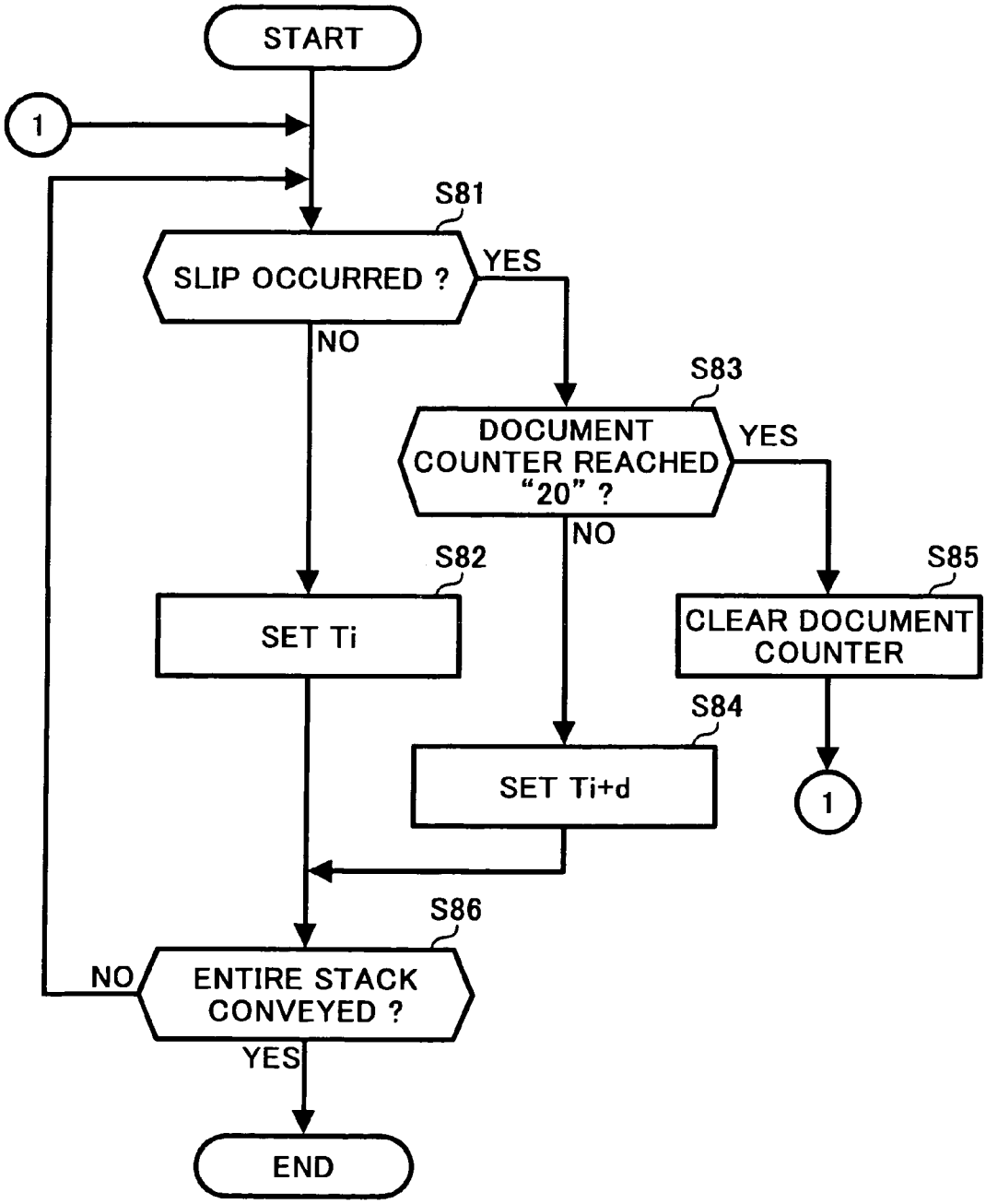
FIG. 17 is a flowchart demonstrating a ninth specific procedure unique to the illustrative embodiment.

More specifically, as shown in FIG. 17, the ADF controller 100 determines, based on information output from the inlet sensor 46 and abutment sensor 42, whether or not the slip ratio has exceeded a preselected value (step S81). If the answer of the step S81 is no, then the ADF controller 100 selects any suitable set time interval Ti (step S82) and conveys documents in accordance with the set time interval Ti.

If the answer of the step S81 is yes, then the ADF controller 100 determines, based on the number of leading edges sensed by the registration sensor 71 when the slip ratio has exceeded the preselected value, whether or not the document counter has reached "20" (step S83). If the answer of the step S83 is no, then the ADF controller 100. extends the set time interval Ti to Ti+α (α=about 0.2 second) (step S84) and causes the successive documents to be conveyed in accordance with the interval Ti+α until the document counter reaches "20".

If the answer of the step S83 is yes, then the ADF controller 100 clears the document counter (step S85) and returns to the step S81. After the step S82 or S84, the ADF controller 100 determines whether or not the entire document stack has been conveyed (step S86). Subsequently, the ADF controller 100 returns to the step S81 if the answer of the step S86 is no or ends the procedure if it is yes, As stated above, the ninth procedure determines a slip ratio and extends, if the slip ratio is greater than preselected one, the time interval between documents up to, e.g., the twentieth document, determining that document jam is apt to occur. This successfully obviates a jam ascribable to slip.

In summary, it will be seen that the present invention provides an ADF capable of preventing read productivity from varying in accordance with, e.g., the slip ratio by controlling a time interval between the restart of conveyance of the preceding document and that of the following document, i.e., a time interval between documents. Therefore, when a copier, for example, executes document reading and image writing at the same time, document reading and image writing are prevented from being brought out of synchronism with each other.

Various modifications will become possible for those skilled in the art after receiving the teachings of the present disclosure without departing from the scope thereof.

What is claimed is:

1. An ADF (Automatic Document Feeder) comprising:

separating and feeding means for feeding a single document from a stack of documents while separating said single document from the other documents;

conveying means for temporarily stopping the document fed by said separating and feeding means at a position preceding a reading position and again conveying, on the elapse of a preselected period of time, said document toward said reading position; and control means for controllably driving said separating and feeding means and said conveying means;

wherein said control means drives said conveying means by controlling a time interval between a restart of conveyance of a preceding document and a restart of conveyance of a following document, and said control means varies the time interval between a start and an end of conveyance of the stack of documents and extends the time interval when a preselected number of documents are conveyed.

2. The ADF as claimed in claim 1, wherein said conveying means comprises a rotatable abut member located at the position preceding the reading position and against which a leading edge of the document is caused to abut, and said control means causes the document to abut against said abut member for thereby temporarily stopping said document and then drives said abut member on the elapse of the preselected period of time.

3. The ADF as claimed in claim 1, wherein the time interval comprises a period of time between the restart of conveyance of the preceding document and an arrival of a trailing edge of said preceding document at the preselected position preceding the reading position.

4. The ADF as claimed in claim 1, further comprising communicating means for communicating with a body of an image processing apparatus, wherein said control means drives said conveying means in accordance with the time interval received from said body via said communicating means.

5. The ADF as claimed in claim 4, wherein said control means receives the time interval determined in accordance with a sheet size and received from the body of the image processing apparatus via said communicating means and drives said conveying means in accordance with said time interval.

6. The ADF as claimed in claim 4, further comprising document size sensing means for sensing a document size, wherein said control means sends the document size sensed by said document size sensing means to the body of the image processing apparatus via said communicating means and drives, on receiving the time interval determined in accordance with said document size from said body via said communicating means, said conveying means in accordance with said time interval received.

7. The ADF as claimed in claim 6, wherein said control means sends the document size of the document conveyed first to the body of the image processing apparatus via said communicating means.

8. The ADF as claimed in claim 6, wherein when the document size sensed by said document size sensing means is a preselected size, said control means sends said document size to the body of the image processing apparatus via said communicating means and drives, on receiving the time interval determined in accordance with said document size from said body via said communicating means, said conveying means in accordance with said time interval.

9. The ADF as claimed in claim 8, wherein when the body of the image processing apparatus operates in a preselected image forming mode, said control means receives the time interval from said body via said communicating means and drives said conveying means in accordance with said time interval received.

10. The ADF as claimed in claim 8, when the document size to be sent to the body of the image processing apparatus is a preselected size and when said body operates in a preselected image forming mode, said control means receives the time interval from said body via said communicating means and drives said conveying means in accordance with said time interval received.

11. An ADF (Automatic Document Feeder) comprising:

separating and feeding means for feeding a single document from a stack of documents while separating said single document from the other documents;

conveying means for temporarily stopping the document fed by said separating and feeding means at a position preceding a reading position and again conveying, on the elapse of a preselected period of time, said document toward said reading position; and control means for controllably driving said separating and feeding means and said conveying means, wherein said control means drives said conveying means by controlling a time interval between a restart of conveyance of a preceding document and a restart of conveyance of a following document, and, when a preselected number of documents are conveyed, said control means interrupts control over the time interval and selects a stop-for-registration mode that temporarily stops the document at a registering position.

12. An ADF (Automatic Document Feeder) comprising:

separating and feeding means for feeding a single document from a stack of documents while separating said single document from the other documents;

conveying means for temporarily stopping the document fed by said separating and feeding means at a position preceding a reading position and again conveying, on the elapse of a preselected period of time, said document toward said reading position;

control means for controllably driving said separating and feeding means and said conveying means, wherein said control means drives said conveying means by controlling a time interval between a restart of conveyance of a preceding document and a restart of conveyance of a following document; and slip detecting means for detecting a slip ratio of the documents being sequentially conveyed by said conveying means, wherein said control means varies, if said slip ratio is greater than a preselected value, the time interval until a preselected number of documents have been conveyed.

13. In an image processing apparatus provided with an ADF, said ADF comprising:

separating and feeding means for feeding a single document from a stack of documents while separating said single document from the other documents;

conveying means for temporarily stopping the document fed by said separating and feeding means at a position preceding a reading position and again conveying, on the elapse of a preselected period of time, said document toward said reading position; and control means for controllably driving said separating and feeding means and said conveying means;

wherein said control means drives said conveying means by controlling a time interval between a restart of conveyance of a preceding document and a restart of conveyance of a following document, and said control means varies the time interval between a start and an end of conveyance of the stack of documents and extends the time interval when a preselected number of documents are conveyed.

14. The apparatus as claimed in claim 13, further comprising a timer for counting the time interval.

15. The apparatus as claimed in claim 13, further comprising communicating means for communicating with a body of the image processing apparatus, wherein said control means drives said conveying means in accordance with the time interval received from said body via said communicating means.

16. The apparatus as claimed in claim 15, wherein said control means receives the time interval determined in accordance with a sheet size received and received from the body of the image processing apparatus via said communicating means and drives said conveying means in accordance with said time interval.

17. The apparatus as claimed in claim 15, further comprising document size sensing means for sensing a document size, wherein said control means sends the document size sensed by said document size sensing means to the body of the image processing apparatus via said communicating means and drives, on receiving the time interval determined in accordance with said document size from said body via said communicating means, said conveying means in accordance with said time interval received.

18. The apparatus as claimed in claim 17, wherein said control means sends the document size of the document conveyed first to the body of the image processing apparatus via said communicating means.

19. The apparatus as claimed in claim 17, wherein when the document size sensed by said document size sensing means is a preselected size, said control means sends said document size to the body of the image processing apparatus via said communicating means and drives, on receiving the time interval determined in accordance with said document size from said body via said communicating means, said conveying means in accordance with said time interval.

20. The apparatus as claimed in claim 19, wherein when the body of the image processing apparatus operates in a preselected image forming mode, said control means receives the time interval from said body via said communicating means and drives said conveying means in accordance with said time interval received.

21. The apparatus as claimed in claim 19, when the document size to be sent to the body of the image processing apparatus is a preselected size and when said body operates in a preselected image forming mode, said control means receives the time interval from said body via said communicating means and drives said conveying means in accordance with said time interval received.

* * * * *